US007156261B2

(12) United States Patent
Saidman et al.

(10) Patent No.: US 7,156,261 B2
(45) **Date of Patent: *Jan. 2, 2007**

(54) HIGH-SPEED LIQUID DISPENSING MODULES

(75) Inventors: Laurence B. Saidman, Duluth, GA (US); Hans Joachim Seedorf, Lüneburg (DE)

(73) Assignee: Nordson Corporation, Westlake, OH (US)

( * ) Notice: Subject to any disclaimer, the term of this patent is extended or adjusted under 35 U.S.C. 154(b) by 359 days.

This patent is subject to a terminal disclaimer.

(21) Appl. No.: 10/657,401

(22) Filed: Sep. 8, 2003

(65) Prior Publication Data

US 2004/0076551 A1 Apr. 22, 2004

Related U.S. Application Data

(62) Division of application No. 09/999,243, filed on Oct. 31, 2001, now Pat. No. 6,669,057.

(51) Int. Cl.
*B67D 5/62* (2006.01)

(52) U.S. Cl. ..... 222/146.5; 222/504; 239/135; 137/375

(58) Field of Classification Search ..... 222/1, 222/146.5, 146.2, 16–22, 504, 330, 132–135; 138/149; 239/135; 118/302; 137/341, 375
See application file for complete search history.

(56) References Cited

U.S. PATENT DOCUMENTS

| | | | | |
|---|---|---|---|---|
| 3,851,146 | A | 11/1974 | Bennett | 219/300 |
| 3,942,687 | A | 3/1976 | Walus et al. | 222/146 |
| 4,962,871 | A | 10/1990 | Reeves | 222/504 |
| RE33,481 | E | 12/1990 | Ziecker et al. | 239/298 |
| 5,336,320 | A | 8/1994 | Hogan et al. | 118/300 |
| 5,407,101 | A | 4/1995 | Hubbard | 222/146.5 |
| 5,495,963 | A | 3/1996 | Miller et al. | 222/318 |
| 5,535,919 | A * | 7/1996 | Ganzer et al. | 222/1 |
| 5,747,102 | A | 5/1998 | Smith et al. | 427/96 |
| 5,772,106 | A | 6/1998 | Ayers et al. | 228/254 |
| 5,934,520 | A | 8/1999 | Byerly et al. | 222/504 |
| 6,036,106 | A | 3/2000 | Peet | 239/135 |
| 6,056,155 | A | 5/2000 | Byerly et al. | 222/1 |
| 6,089,413 | A | 7/2000 | Riney et al. | 222/318 |
| 6,164,568 | A | 12/2000 | Muller et al. | 239/586 |
| 6,253,957 | B1 | 7/2001 | Messerly et al. | 222/1 |

(Continued)

FOREIGN PATENT DOCUMENTS

| | | |
|---|---|---|
| DE | 10010952 | 9/2001 |

*Primary Examiner*—Frederick C. Nicolas
(74) *Attorney, Agent, or Firm*—Wood, Herron & Evans, L.L.P.

(57) ABSTRACT

Liquid dispensing module and methods for dispensing a heated liquid onto a substrate. The dispensing module includes a dispenser body receiving liquid from a heated liquid distribution manifold and an actuator having a housing with an air piston movable in an air cavity and a solenoid valve for pressurizing the air cavity. Movement of the air piston controls a flow-regulating mechanism for selectively dispensing liquid from the dispenser body. A thermally insulating shield may be provided for reducing heat transfer from the manifold and/or dispenser body to the actuator so that the solenoid valve can be mounted directly to the housing and the effective volume of the air cavity can be reduced. The cycle time of the liquid dispensing module may be specified by selecting an initial volume of the air cavity and an effective valve flow coefficient for the actuator that characterizes the air flow to the air cavity.

53 Claims, 6 Drawing Sheets

U.S. PATENT DOCUMENTS 6,257,445 B1 7/2001 Means et al. ..... 222/1
6,279,603 B1 8/2001 Czarnik et al. ..... 137/339
6,296,463 B1 10/2001 Allen ..... 425/7
6,422,428 B1 7/2002 Allen et al. ..... 222/318
6,499,631 B1 12/2002 Zook ..... 222/146.6
6,669,057 B1 * 12/2003 Saidman et al. ..... 222/146.5

* cited by examiner

HIGH-SPEED LIQUID DISPENSING MODULES

CROSS-REFERENCE TO RELATED APPLICATIONS

This application is a divisional of application Ser. No. 09/999,243, filed Oct. 31, 2001, now U.S. Pat. No. 6,669,057, the disclosure of which is hereby fully incorporated by reference herein.

FIELD OF THE INVENTION

The present invention generally relates to liquid dispensing and, more particularly, to liquid dispensing modules for dispensing heated liquids onto a surface of a substrate.

BACKGROUND OF THE INVENTION

Various liquid dispensing modules have been developed for the precise application of a heated liquid, such as a thermoplastic hot melt adhesive, on a substrate. In many dispensing applications, the flow of heated liquid must be periodically interrupted to sharply delimit the leading and trailing edges of individual application zones in a pattern of heated liquid applied on the substrate. To that end, most liquid dispensing modules have an open position in which heated liquid is discharged and a closed position in which the flow of heated liquid is blocked. Rapid cycling between the open and closed positions interrupts the flow and provides the high-speed intermittent flow discontinuities required to generate the pattern of heated liquid.

For modulating the flow of heated liquid, liquid dispensing modules generally include an actuator and a dispenser body having a valve seat and a valve plug operatively connected with the actuator for movement relative to the valve seat. In the open position, the actuator operates to space the valve plug from the valve seat so that heated liquid can flow through a series of internal passageways to a discharge orifice in the dispenser body. In the closed position, the valve plug engages the valve seat so that flow is blocked. Liquid dispensing modules are characterized by an intrinsic cycle time, which includes the time required to actuate from the closed position to the open position and the time required to return to the closed position. The liquid dispensing module is maintained in the open position for a dispensing time sufficient to tailor the application zones of the desired application pattern.

Liquid dispensing modules are often pneumatically actuated with pressurized fluid to provide the open and closed positions. In such modules, the actuator includes a solenoid valve that regulates the application of the pressurized fluid to an air cavity, an air piston displaced in response to the application of pressurized air to the air cavity, and an air piston housing in which the air piston and air cavity are disposed. The air piston is operatively coupled with the valve plug in the dispenser body and provides at least the motive force that produces the open position of the module. The shortest cycle times are achieved when the solenoid valve is attached in direct contact with the air piston housing.

The dispenser body of the liquid dispenser module is often fluidically coupled with a liquid distribution manifold. Heated liquid from a heated liquid supply flows through various internal passageways in the liquid distribution manifold and the liquid dispensing module before being applied on the substrate. Heated liquid flowing through the liquid distribution manifold and the liquid dispensing module will attempt to thermally equilibrate with the surrounding walls of the passageways. If the heated liquid cools below a threshold temperature, it may not remain flowable and/or molten or may not have the desired properties when applied on the substrate. To avoid the detrimental effects of cooling, the liquid distribution manifold is provided with heating elements that elevate the temperature of the manifold. Heat transfer from the liquid distribution manifold heats the liquid dispensing module. Alternatively, the liquid dispensing module may incorporate independent heating elements. For specific dispensing operations in which the heated liquid is a hot melt adhesive, it is desirable maintain the liquid distribution manifold and the liquid dispensing module at an operating temperature exceeding about 250° F. and as high as about 400° F.

Significant heat transfer also occurs from the liquid distribution manifold and the dispenser body to the air piston housing. Because the solenoid valve is in thermal contact with the air piston housing, this transferred heat can be further transferred from the air position housing to the solenoid valve. The transferred heat elevates the operating temperature of the solenoid valve, which can approach the operating temperature of the liquid distribution manifold. If the operating temperature rises above a certain threshold temperature, the solenoid valve cannot operate properly and may malfunction, suffer permanent damage, or fail.

The designs of certain conventional liquid dispensing modules attempt to reduce the heating of the solenoid valve by spacing it physically from the air piston housing. To do so, a nipple or a length of tubing must provided to fluidically couple an air outlet of the solenoid valve with an air inlet of the air piston housing leading to the air cavity. The nipple or tubing reduces the path for conduction of heat from the actuator to the housing of the air cavity. However, the volume of the air space within the nipple or tubing increases the effective air volume of the air cavity that must be pressurized in order to actuate the air piston. The increase in the effective air volume increases the cycle time of the actuator. In such applications, the smallest effective air volume for conventional air cavities is greater than 2170 $mm^3$. The fastest of conventional liquid dispensing modules designed with such effective air volumes have cycle times, excluding the time required for switching the flow of pressurized fluid within the solenoid valve and the actual dispensing time, that exceed 9 milliseconds. It follows that simply spacing the solenoid valve from the housing containing the air cavity with a nipple or a length of tubing is not an adequate solution for reducing the heating of the solenoid valve in those dispensing applications requiring a cycle time of 9 milliseconds or less.

The transfer of heat from the dispenser body and the distribution manifold also reduces the useful lifetime of the solenoid valve. Manufacturers of common solenoid valves recommend a maximum temperature for continuous operation of less than about 140° F. If the solenoid valve is equipped with custom high-temperature seals, the heat-tolerance of the valve increases so that it can operate continuously at temperatures greater than 140° F. and as high as about 225° F. However, the addition of high-temperature seals to the solenoid valve further increases the cycle time because of the softness of the material composing the high-temperature seals. Therefore, equipping a solenoid valve with high-temperature seals permits the valve to operate over a larger temperature range but presents a significant liability for high-speed dispensing operations.

Moreover, even if a solenoid valve is equipped with such high-temperature seals, it still cannot operate reliably if heated above about 225° F.

What is needed, therefore, is a liquid dispensing module for dispensing a heated liquid that can reduce the transfer of heat from the liquid dispensing module and the heated liquid distribution manifold to the pneumatic actuator. Also needed is a liquid dispensing module having a reduced cycle time for dispensing liquids, including heated liquids.

SUMMARY OF INVENTION

The present invention provides apparatus and methods for dispensing a heated liquid. In accordance with the principles of the present invention, an apparatus for dispensing a liquid includes a liquid distribution manifold capable of heating the liquid, a dispenser body capable of receiving a flow of the liquid from said liquid distribution manifold, and a pneumatic actuator. The dispenser body is equipped with a flow-control mechanism having a first condition in which the flow of the liquid is discharged from the dispenser body and a second condition in which the flow of the liquid is blocked. The pneumatic actuator has a solenoid valve equipped with an air outlet, an air piston housing, an air cavity disposed within the air piston housing and having an air inlet, and an air piston operatively positioned for movement within the air cavity. The air piston is operatively coupled with the flow-control mechanism for providing the first and second conditions. The solenoid valve is capable of controlling a flow of pressurized fluid to the air cavity and is mounted in abutting, thermally-conductive contact with the air piston housing so that the air outlet and air inlet are substantially coextensive. A thermally insulating shield is positioned between the pneumatic actuator and the liquid distribution manifold. The shield is capable of reducing the transfer of heat from the liquid distribution manifold to the pneumatic actuator.

According to the principles of the present invention, an apparatus for dispensing a hot melt adhesive includes a dispenser body capable of receiving and discharging a flow of the liquid and a pneumatic actuator. The dispenser body has a flow-control mechanism having a first condition in which the flow of the liquid is discharged from the dispenser body and a second condition in which the flow of the liquid is blocked. The pneumatic actuator has an air piston housing containing an air cavity, an air piston disposed for movement in the air cavity, and a solenoid valve capable of controlling the flow of pressurized air to and from the air cavity for selectively applying an actuation force to the air piston and removing the actuation force from the air piston. The air piston is operatively coupled with the flow-control mechanism for providing the first condition when the actuation force is applied and the second condition when the actuation force is removed. The air cavity has an initial air volume and the pneumatic actuator has an effective valve flow coefficient that may be selected such that the cycle time is less than or equal to 9 milliseconds.

In other embodiments, the initial air volume of the air cavity and effective valve flow coefficient of the pneumatic actuator may be selected such that the cycle time is less than or equal to 5 milliseconds. In still other embodiments, the apparatus of claim may include a heater for heating the liquid and a thermally insulating shield positioned between the pneumatic actuator and the heater for reducing the transfer of heat from the heater to the air piston housing so that the solenoid valve is mountable in abutting, thermally-conductive contact with the air piston housing.

According to the principles of the present invention, a method of optimizing a cycle time of a liquid dispensing module comprises providing a liquid dispensing module having a dispenser body capable of receiving and discharging a flow of the liquid and a pneumatic actuator in which the dispenser body includes a flow-control mechanism having a first condition in which the flow of the liquid is discharged from the dispenser body and a second condition in which the flow of the liquid is blocked, the pneumatic actuator includes an air piston housing containing an air cavity, an air piston located in the air cavity, and a solenoid valve capable of controlling the flow of pressurized air to and from the air cavity for alternatively applying an actuation force to the air piston and removing the actuation force from the air piston, the air piston operatively coupled with the flow-control mechanism for providing the first condition when the actuation force is applied and the second condition when the actuation force is removed, the air cavity has an initial air volume, and the pneumatic actuator has an effective valve flow coefficient. The method further comprises specifying a first value for one of the initial air volume and the effective valve flow coefficient and then determining a second value of the other of the initial air volume and the effective valve flow coefficient such that the cycle time is less than or equal to 9 milliseconds.

The method may include the additional steps of heating the liquid received by the dispenser body with a heater and thermally insulating the housing of the pneumatic actuator from the heater for reducing the transfer of heat from the heater to the housing so that the solenoid valve is mountable in abutting, thermally-conductive contact with the air piston housing.

Various additional advantages and features of the invention will become more readily apparent to those of ordinary skill in the art upon review of the following detailed description taken in conjunction with the accompanying drawings.

DETAILED DESCRIPTION

Figure 1:
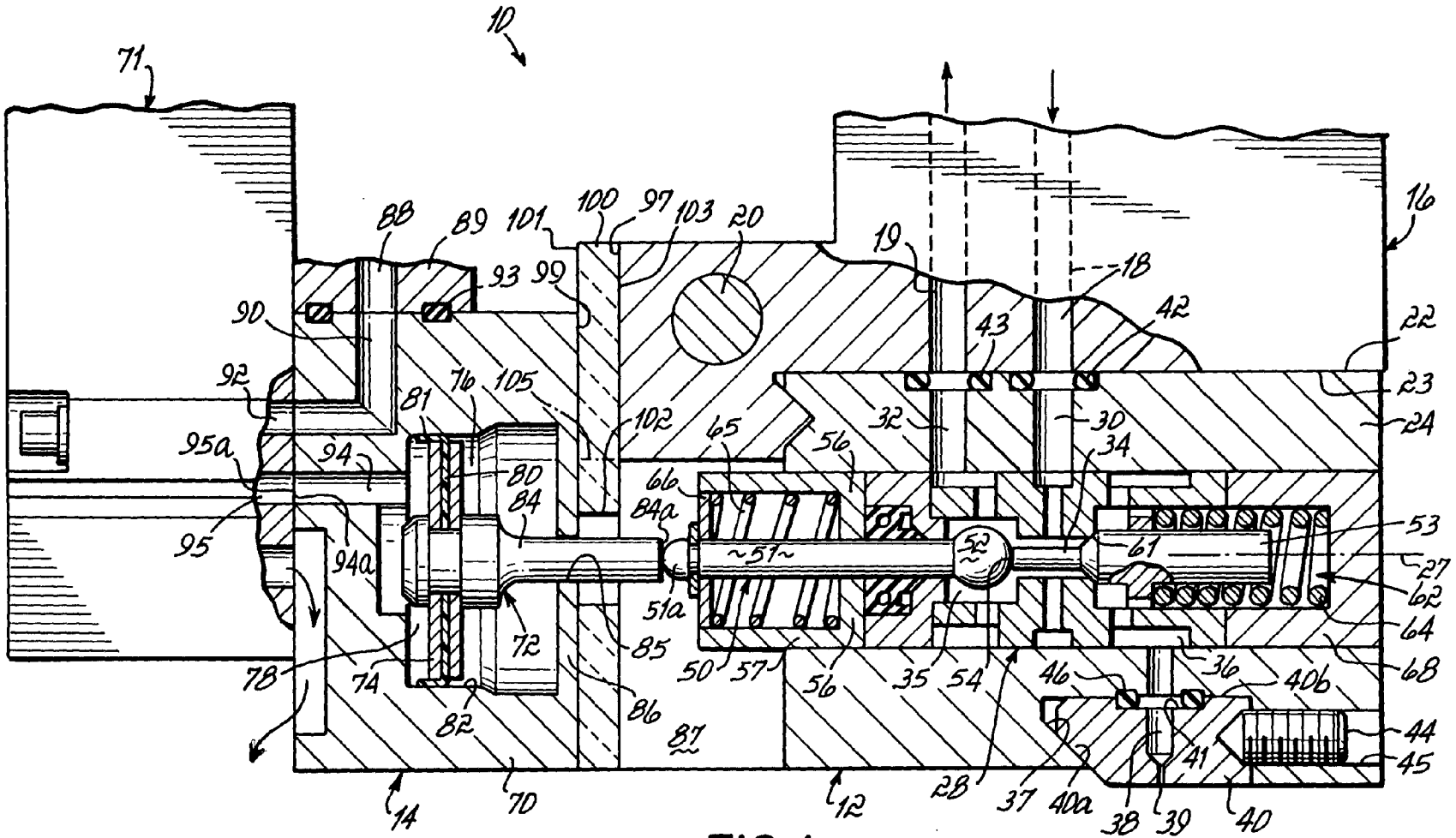
FIG. 1 is a cross-sectional view of a liquid dispensing module constructed in accordance with the invention, with the dispensing module in a closed position.
Figure 2:
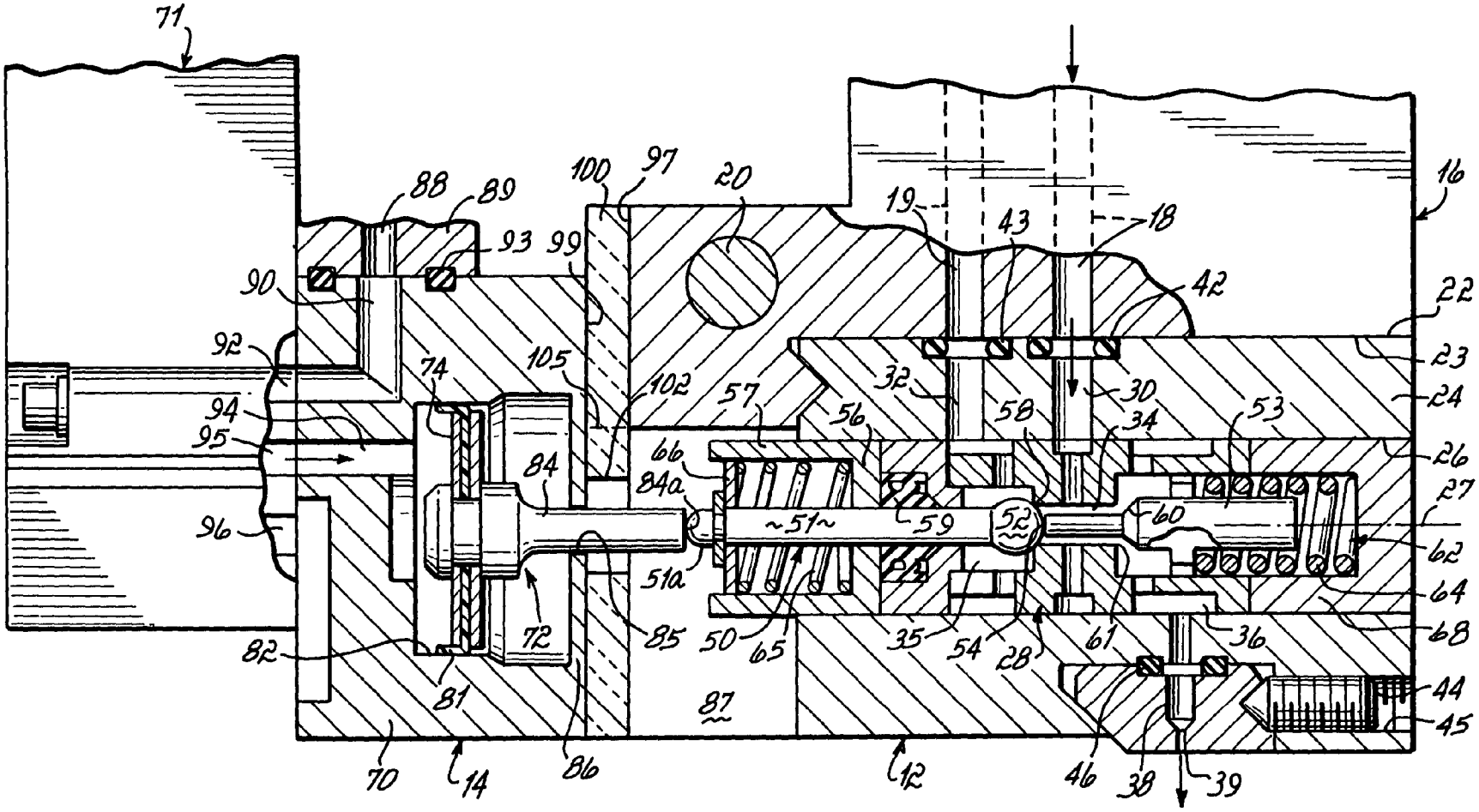
FIG. 2 is a cross-sectional view similar to FIG. 2 in which the dispensing module is in an open position.

With reference to FIGS. 1 and 2, a liquid dispensing module 10 constructed in accordance with the principles of the present invention includes a dispenser body 12 and an actuator 14. The liquid dispensing module 10 is specifically adapted for dispensing a heated liquid, such as a molten thermoplastic hot melt adhesive. However, other heated liquid dispensing modules will also benefit from principles of the present invention. The liquid dispensing module 10 constitutes a flow control device adapted to accept a flow of a heated liquid and dispense the heated liquid in a controlled fashion onto a substrate. The liquid dispensing module 10 is configured to be actuated by the actuator 14 between an open position (FIG. 2), in which heated liquid is dispensed from the dispenser body 12, and a closed position (FIG. 1), in which the dispensing of heated liquid is halted.

The dispenser body 12 is mounted in a conventional manner to liquid distribution manifold 16. Liquid distribution manifold 16 includes a supply passageway 18 for providing quantities of the heated liquid from a source of heated liquid (not shown) and a recirculation passageway 19 providing a flow pathway for returning heated liquid back to the source when the liquid dispensing module 10 is in the closed position. One or more heaters or heater elements 20 are disposed in corresponding bores provided in liquid distribution manifold 16. The heater elements 20 convert electrical energy into heat that is transferred to liquid distribution manifold 16 to maintain the heated liquid flowing within the supply passageway 18 and the recirculation passageway 19 at a desired temperature. The liquid distribution manifold 16 also provides an external heat source that heats the dispenser body 12 through heat transfer to maintain the heated liquid within body 12 at a desired application temperature. To that end, one side 22 of the liquid distribution manifold 16 abuts and has a good thermal contact with one face 23 of the dispenser body 12. It is understood that the present invention is not limited by the structure of heater elements 20 and other heat sources are contemplated for heating the liquid distribution manifold 16.

With continued reference to FIGS. 1 and 2, the dispenser body 12 includes a sidewall 24 having a central cylindrical throughbore 26 extending along a longitudinal axis 27 of body 12 and a centrally-positioned, flow-directing insert 28 located in the throughbore 26. Extending through the sidewall 24 of the dispenser body 12 are an inlet passageway 30 registered with the supply passageway 18 and a recirculation passageway 32 registered with the recirculation passageway 19. Seals 42 and 43, such as O-rings, are disposed in respective countersunk recesses about the respective inlet openings of passageways 32 and 30 so as to prevent leakage of heated liquid between the liquid distribution manifold 16 and the dispenser body 12.

The flow-directing insert 28 includes a flow chamber 34 fluidically coupled with the supply passageway 30 and a recirculation chamber 35 in selective fluid communication with the flow chamber 34. The flow chamber 34 provides a liquid pathway to a discharge passageway 36, which has an outlet registered with an inlet of a discharge passageway 38 in a nozzle 40. The discharge passageway 38 terminates in a discharge orifice 39 from which heated liquid is dispensed onto a substrate (not shown). The nozzle 40 is fluidically sealed against the dispenser body 12 by a seal 46, such as an O-ring, positioned in a shallow gland formed in the dispenser body 12 so as to prevent leakage of heated liquid between the nozzle 40 and the dispenser body 12. The dispenser body 12 and nozzle 40 are constructed of a material having a significant thermal conductivity, such as brass, an aluminum or aluminum alloy, or a stainless steel.

The nozzle 40 is removably attached to the dispenser body 12 by a conical-tipped set screw 44. Set screw 44 is advanced in a threaded bore 45 to contact a conical notch formed in the nozzle 40. The force applied by advancement the set screw 44 urges a wedged-shaped side portion 40*a* of the nozzle 40 into a correspondingly wedge-shaped recess 37 formed in the dispenser body 12. The dispensing characteristics of the discharge orifice 39 can be modified by loosening set screw 44 and replacing nozzle 40 with a different nozzle 40 having, for example, a discharge orifice of a different configuration and/or sizing. A circular recess 41 is provided in the nozzle 40 about the inlet to the discharge passageway 38. The circular recess 41 receives seal 46 and promotes an abutting engagement between an upper face 40*b* of the nozzle 40 and the dispenser body 12 by having a depth relative to face 40*b* dimensioned to accommodate the thickness of the seal 46. The close contact between the nozzle 40 and the dispenser body 12 promotes heat transfer therebetween for efficiently heating the nozzle 40.

With continued reference to FIGS. 1 and 2, centrally located in the throughbore 26 of the dispenser body 12 is a divided stem assembly 50. Stem assembly 50 is axially bifurcated into an elongated first stem segment 51 with spherical head 52 at one end and an elongated second stem segment 53 having a concave end face 54 abutting the spherical head 52 of the first stem segment 51. The first and second stem segments 51 and 53 are generally coaxial with the longitudinal axis extending along the longitudinal centerline of throughbore 26 in the dispenser body 12. The first stem segment 51 extends through a circular opening provided in an annular dividing wall 56 of a cup-shaped insert 57, which is disposed inside one end of the throughbore 26. The dispenser body 12 includes an annular valve seat 58 dimensioned and configured to produce a sealing engagement with the spherical head 52 when the valve seat 58 and spherical head 52 are contacting. The second stem segment 53 is provided with an annular, frustoconical sealing surface 60 dimensioned and configured to produce a sealing engagement, when the sealing surface 60 and valve seat 61 are contacting, with an annular, frustoconical valve seat 61, provided on the flow-directing insert 28 and positioned at the juncture of the flow chamber 34 and discharge passageway 36. The pneumatic actuator 14 provides a controlled, reciprocating movement of sealing surface 60 into and out of engagement with seat 61 and spherical head 52 into and out of engagement with valve seat 58. An annular rod seal 59 is provided within a gland formed in throughbore 26. The first stem segment 51 is received coaxially through an inner bore of the rod seal 59 for reciprocation within the throughbore 26. As the stem assembly 50 reciprocates along a longitudinal axis within the throughbore 26, the rod seal 59 provides a dynamic seal with an outer surface of the first stem segment 51 and wipes heated liquid therefrom.

While the first stem segment 51 is illustrated with a spherical head 52, it will be appreciated that other head shapes are contemplated by the present invention. Similarly, the configuration of the frustoconical sealing surface 60 and frustoconical valve seat 61 may be altered to other effective sealing arrangements of complementary sealing surfaces and seats without departing from the spirit and scope of the present invention.

With continued reference to FIGS. 1 and 2, the dispenser body 12 further includes a spring return mechanism 62 operatively connected to the first and second stem segments 51 and 53. The spring return mechanism 62 includes a cup-shaped insert 68 disposed in throughbore 26 near one longitudinal end of the dispenser body 12, a biasing element 64 disposed within a recess formed in the cup-shaped insert 68, and another biasing element 65 disposed in a recess within the cup-shaped insert 57 at the opposite end of the dispenser body 12. Biasing element 64, illustrated in FIGS. 1 and 2 as a compression spring, is held in a compressed state within the cup-shaped insert 68. Biasing element 65, also illustrated in FIGS. 1 and 2 as a compression coil spring, is compressed between the dividing wall 56 and an annular disk 66 that is affixed by a fastener to the first stem segment 51. The annular disk 66 is free to move axially with the recess of the cup-shaped insert 57. The biasing element 65 applies a biasing force to the first stem segment 51 that urges the spherical head 52 in a direction away from the valve seat 58. Biasing element 64 applies a biasing force to the second stem segment 53 that is directed to urge the frustoconical sealing surface 60 toward the frustoconical valve seat 61. The net biasing force applied by biasing elements 64 and 65 to the divided stem assembly 50, when the liquid dispensing module 10 is in a closed position, is such that the frustoconical sealing surface 60 contacts the frustoconical valve seat 61 to prevent the flow of the liquid from flow chamber 34 to the discharge passageway 36 and spherical head 52 is out of contact with the valve seat 58 to permit the flow of the liquid from flow chamber 34 to the recirculation chamber 35 and recirculation passageway 32. In the open position, the spherical head 52 contacts valve seat 58 to stop the flow of the liquid from flow chamber 34 to the recirculation chamber 35 and the frustoconical sealing surface 60 is out of contact with the frustoconical valve seat 61 to permit the flow of the liquid from flow chamber 34 to the discharge passageway 36.

With continued reference to FIGS. 1 and 2, the actuator 14 includes an air piston housing 70, a solenoid valve 71 attached to air piston housing 70, and a plunger 72. One end of the plunger 72 carries an air piston 74 that is slidably movable within a plenum 76 formed in the air piston housing 70. The air piston 74 divides the plenum 76 to define an air cavity 78 that varies volumetrically as the air piston 74 moves within plenum 76. Extending about the outer periphery of the air piston 74 is an annular seal 80 having a circumferential sealing lip 81 that provides a fluid-tight sliding seal with a surface of interior sidewall 82 surrounding the plenum 76. The seal 80 is formed of a polymeric material, such as RULON®, suitable for use as a fluid seal in the heated environment of the air piston housing 70. Air piston 74 defines a longitudinally-movable confinement wall for air cavity 78.

Extending away from the air piston 74 toward the dispenser body 12 is a shaft 84 that projects through a shaft opening 85 in a sidewall 86 of the air piston housing 70. The shaft 84 terminates in a cusped or concave end face 84*a* that contacts a complementary rounded or convex face 51*a* provided at one end of the first stem segment 51. It is apparent from FIGS. 1 and 2 that dispenser body 12 is spaced apart or separated from actuator 14 by a gap 87 so that the only physical coupling between the dispenser body 12 and the actuator 14 is the area of contact between end face 84*a* and convex surface 51*a*. The minimization of the contact area reduces the transfer of heat by conduction from the dispenser body 12 to the actuator 14 by reducing the cross-sectional area of the conductive pathway therebetween. The physical separation due to gap 87 also reduces the amount of heat transferred by convection or radiative transfer from the dispenser body 12 to the actuator 14.

Pressurized actuation air is supplied from an air passageway 88 of an air distribution manifold 89 through a registered air passageway 90 in the air piston housing 70 that leads to a supply duct 92 of the solenoid valve 71. A seal 93, such as an O-ring, is disposed about the respective inlet openings of air passageways 88 and 90 for preventing leakage of actuation air between the air distribution manifold 89 and the air piston housing 70. The air piston housing 70 further includes an air passageway 94 fluidically coupling the air cavity 78 with an access duct 95 of the solenoid valve 71. An air inlet 94*a* (FIG. 1) of air passageway 94 is substantially coextensive with an air outlet 95*a* (FIG. 1) of access duct 95.

Pressurized actuation air is supplied to air cavity 78 by an air actuation source (not shown). The maximum air pressure of the actuation air, typically ranging from about 10 pounds per square inch (p.s.i.) to about 120 p.s.i., is selected to be effective for overcoming the various opposing forces to movement of air piston 74, including resistances provided by the spring return mechanism 62 and the pressurized heated liquid. The face of the air piston 74 exposed to the actuation gas has an active surface area that contributes to determining the magnitude of the actuation force, given by the product of the air pressure and the active surface area, applied to the stem assembly 50. When air piston 74 moves within plenum 76, the volume of the air cavity 78 varies. However, the air cavity 78 has a well-defined initial air volume, which is considered to also include the volume of air passageway 94 and access duct 95, when the liquid dispensing valve 10 is in the closed position.

As shown in FIG. 1, the connection between the air inlet 94*a* and air inlet 95*a* is direct and free of intervening lengths of tubing and/or fittings. The absence of intervening tubing and/or fittings permits the initial air volume of the air cavity 78 to be minimized for reducing the cycle time of the liquid dispensing module 10. It is appreciated that a seal (not shown), such as an o-ring seal or gasket, may be disposed about the junction between the air inlet 94*a* and air inlet 95*a* to prevent leakage of actuation air between the solenoid valve 71 and the air piston housing 70. The solenoid valve 71 is mounted in an abutting, thermally-coupled contact with the air piston housing 70 and is in thermal communication therewith for heat flow therebetween.

The initial air volume and sizing of the air cavity 78 are constrained by the size of air piston 74. The surface area of the air piston 74 must be large enough, given the operating air pressure, to provide a force effective to overcome the opposing forces and move air piston 74. It follows that the air cavity 78 must be dimensioned appropriately to accommodate air piston 74. When the actuation air is switched by the solenoid valve 74 to direct actuation air through air passageway 94, actuation air enters air cavity 78 through access duct 95. The air pressure in air cavity 78 increases as actuation air enters and, when the air pressure reaches a certain threshold value, the force applied to the active surface area of the air piston 74 is sufficient to cause movement within air chamber 78. The initial air volume of the air cavity 78, among other parameters, determines the threshold value. Direct attachment of the solenoid valve 71 to the air piston housing 70 permits the initial air volume of the air cavity 78 to be less than about 2170 $mm^3$ and, in particular, less than about 1500 $mm^3$, while retaining an active surface area for air piston 74 effective to actuate the liquid dispensing module 10 from a closed position to an open position.

Solenoid valve 71 constitutes an air control valve and typically includes a movable spool actuated by an electromagnetic coil (not shown), which cooperate for selecting a flow path from among various flow paths to direct a flow of actuation air or to exhaust actuation air. Specifically, the solenoid valve 71 may be switched to either fill the air cavity 78 with pressurized actuation air by fluidically coupling the air passageway 90 with the access duct 95 and air passageway 94 or switched to exhaust pressurized actuation air from the air cavity 78 by fluidically coupling the air passageway 94 and access duct 95 with an exhaust duct 96. Exhaust duct 96 vents to the ambient environment outside of the air piston housing 70. The regulated flow of actuation air provided by the solenoid valve 71 contributes for providing high-speed intermittent adhesive placement on a substrate (not shown).

The actuator 14 of the liquid dispensing module 10 is characterized by an effective valve flow coefficient. Solenoid valve 71 is characterized by an ideal valve flow coefficient ranging from about 0.1 to about 1.4, which is greater than or equal to the effective valve flow coefficient of the actuator 14. The effective valve flow coefficient of the actuator 14 is reduced relative to the ideal valve flow coefficient by the flow characteristics of the various flow passageways in the air piston housing 70. The effective valve flow coefficient of the actuator 14 asymptotically approaches the ideal valve flow coefficient of the solenoid valve 71 as the fluid capacitance and resistance of the various flow passageways in the air piston housing 70 are reduced. The solenoid valve 71 may be, for example, any three-way or four-way valve that operates to switch a flow of actuation air among various flow paths as understood by those of ordinary skill in the art. A product line of three-way and four-way solenoid valves suitable for use as solenoid valve 71 is commercially available, for example, from MAC Valves, Inc. (Wixom, Mich.).

In operation, the actuator 14 selectively applies an actuation force to the stem assembly 50 to actuate the liquid dispensing module 10 between the closed position of FIG. 1 and the open position shown in FIG. 2. To that end, the solenoid valve 71 is switched so that a flow path is created between the supply duct 92 and the access duct 95. Actuation air flows from the actuation air source (not shown) through an interconnected pathway comprising the air passageways 90 and 94, the supply duct 92 and the access duct 95 into the air cavity 78. Actuation air pressurizes the air cavity 78 and applies an actuation force to the plunger 72 that urges the air piston 74 and shaft 84 in a direction toward the stem assembly 50 (FIG. 2). The movement of the plunger 72 increases the volume of the air cavity 78 to a given maximum volume when the stem assembly 50 is in the open position. The sealing lip 81 of annular seal 80 maintains a fluid-tight sliding seal with the interior sidewall 82 as the plunger 72 moves. The actuation force is transmitted by the concave end face 84*a* of the shaft 84 to the convex face 51*a* of the first stem segment 51. The ensuing displacement of the stem assembly 50 actuates the liquid dispensing module 10 to the open position in which the frustoconical sealing surface 60 is spaced from the frustoconical valve seat 61 to create an annular opening therebetween and the spherical head 52 engages valve seat 58 with a fluid-tight engagement. Heated liquid flows from the flow chamber 34 through the annular opening between the frustoconical sealing surface 60 and frustoconical valve seat 61 into discharge passageways 36, 38 and is dispensed from the discharge orifice 39 of nozzle 40. Collectively, the supply passageway 30, the flow chamber 34 and the discharge passageway 36 provide a flow channel in the open condition, which provides heated liquid to the discharge passageway 38. Heated liquid cannot flow from the flow chamber 34 into the recirculation chamber 35 due to the engagement between spherical head 52 and valve seat 58.

To return from the open position to the closed position, the solenoid valve 71 closes the flow path of actuation air from the supply duct 92 to the access duct 95 and opens a flow path between the access duct 95 and the exhaust duct 96. Actuation air drains from the air cavity 78 through an interconnected pathway comprising the air passageway 94, the access duct 95 and the exhaust duct 96 to the exterior of the solenoid valve 71 where the exhausted air commingles with the ambient atmosphere. As the air cavity 78 returns to an ambient pressure, the actuation force applied to the air piston 74 and shaft 84 is gradually removed from the stem assembly 50. When the magnitude of the actuation force applied to the stem assembly 50 becomes less than the force applied by the spring return mechanism 62, the spring return mechanism 62 urges the stem assembly 50 toward the actuator 14. As that occurs, the plunger 72 moves so that the volume of the air cavity 78 decreases and eventually returns to the initial air volume in the closed position. In the closed position, as shown in FIG. 1, the spherical head 52 is spaced from the valve seat 58 so that an annular opening is created therebetween. Heated liquid flows from the flow chamber 34 into the recirculation chamber 35 through the annular opening between the spherical head 52 and the valve seat 58. The heated liquid in the recirculation chamber 35 exits from the dispenser body 12 via the recirculation passageways 19, 32 and returns to the liquid distribution manifold 16. Collectively, the supply passageway 30, the flow chamber 34, the recirculation chamber 35, and recirculation passageway 32 provide a flow channel in the closed condition which provides heated liquid to the recirculation passageway 19. The frustoconical sealing surface 60 engages the frustoconical valve seat 61 so that heated liquid cannot flow from the flow chamber 34 into the discharge passageway 36. As a result, the spray of heated liquid from the discharge orifice 39 in nozzle 40 ceases.

One cycle of the liquid dispensing module 10 can be considered to consist of the sum of the time required for actuation air to pressurize the initial air volume of the air cavity 78 from atmospheric pressure, typically about 14.7 p.s.i.a., to an air pressure effective to overcome stiction and initiate movement of the plunger 72, the time required for the plunger 72 to move to fully actuate the stem assembly 50 during which the volume of the air cavity 78 increases, an infinitesimal dispensing time, the time required to exhaust air pressure from the air cavity 78 and for the spring return mechanism 68 return the stem assembly 50 and plunger 72 to a closed position in which the air cavity 78 reassumes to its initial air volume, and the time required to return the air pressure in air cavity 78 to atmospheric pressure. As defined, the cycle time excludes the time required to switch the flow in the solenoid valve 71 to initiate pressurization of the air cavity 78, the time required to switch the flow in the solenoid valve 71 to precipitate depressurization of the air cavity 78, and the dispensing time during which liquid is dispensed from the discharge orifice 39 of nozzle 40.

With continued reference to FIGS. 1 and 2, the liquid dispenser includes a thermally insulating shield 100 that may comprise any composition, construction and/or configuration having thermal properties effective to eliminate or significantly reduce the transfer of heat by conduction, convection and/or radiative transfer from the liquid distribution manifold 16 and/or the dispenser body 12 to the actuator 14. The presence of the thermally insulating shield 100 participates in reducing the temperature of the actuator 14 when the liquid distribution manifold 16 and dispensing body 12 are heated, as is the case when dispensing a heated liquid. The thermally insulating shield 100 physically separates, shields and/or shadows the air piston housing 70 of the actuator 14 from the liquid distribution manifold 16 and the dispenser body 12 so that heat transfer is either prevented or reduced. As a direct result of the presence of the thermally insulating shield 100, the actuator 14 will have a reduced operating temperature. This will extend the lifetime of the actuator 14 and also permit the actuator 14 to perform with rapid cycle times for moving the stem assembly 50 from a closed position to an open position and/or retracting the stem assembly 50 from an open position to a closed position. In particular, the presence of the thermally-insulating shield 100 permits direct connection of the solenoid valve 71 to the air piston housing 70.

The composition, construction and/or configuration required to construct the thermally insulating shield 100 will depend upon the particular operating temperature of the dispenser body 12 and the liquid distribution manifold 16. In an application in which the heated liquid is a hot melt adhesive, the dispenser body 12 and the liquid distribution manifold 16 are maintained at a temperature in the range of about 250° F. to about 400° F. The thermally insulating shield 100 should have a composition, construction and/or configuration to maintain the temperature of the solenoid valve 71 below a maximum operating temperature characteristic of the particular dispensing operation.

In the embodiment shown in FIGS. 1 and 2, the thermally insulating shield 100 comprises a sheet or layer of a material having a lesser thermal conductivity than the material, typically a metal, forming the air piston housing 70 of the actuator 14. The portion of the thermally insulating shield 100 between the air piston housing 70 and the liquid distribution manifold 16 is imperforate. A single shaft opening 102, generally aligned with shaft opening 85, is provided in another portion of shield 100 through which the shaft 84 of the plunger 72 projects for operatively coupling with the stem assembly 50. The thermally insulating shield 100 is positioned with one generally planar face 101 in an abutting contact with a generally planar surface 99 of the air piston housing 70 of the actuator 14 and another generally planar face 103 in an abutting contact with a generally planar surface 97 of the liquid distribution manifold 16.

It is understood by those of ordinary skill in the art that the configuration of the thermally insulating shield 100 may differ from that illustrated in FIGS. 1 and 2. For example, the portions of the thermally insulating shield 100 shielding the actuator 14 against heat transfer from the dispenser body 12 may be omitted if heat transfer from body 12 to actuator 14 is relatively insignificant. In that configuration, the thermally insulating shield 100 is present between surface 97 and the confronting portion of surface 99 and portions of the shield 100 are omitted in the line-of-sight paths in gap 87 from the dispenser body 12 to the actuator 14. The optional truncation of the thermally insulating shield 100 is indicated in FIGS. 1 and 2 by dashed line 105 and would omit the portion of shield 100 containing the shaft opening 102. The significance of the heat transfer to the actuator 14 from the dispenser body 12, which would control the ability to truncate thermally insulating shield 100, will depend upon the operating temperature, with the significance rising with increasing operating temperature. In addition, the cross-sectional area of the thermally insulating shield 100, viewed parallel to the surface normal of either surface 101 or surface 103, may be varied. The thermally insulating shield 100 may alternatively assume the form of, for example, multiple discs or washers (not shown) of a material having a low thermal conductivity and captured between surface 99 of liquid distribution manifold 16 and the confronting portion of surface 97 of housing 90.

Materials suitable for fabricating the thermally insulating shield 100 include non-metals, such as polymers and ceramics, having thermal conductivities significantly less than the thermal conductivities of common metals used to fabricate the air piston housing 70. Common polymers having temperature resistances and thermal conductivities suitable for forming the thermally insulating shield 100 include polyetheretherketone (PEEK), polyamide-imide (PAI), and various fluoropolymers, including polytetrafluoroethylene (PTFE), fluorinated ethylene propylene (FEP), and perfluoroalkoxy copolymer (PFA). A suitable family of fluoropolymers is marketed under the trade name TEFLON® by E. I. du Pont de Nemours and Company (Wilmington, Del.). The maximum temperature for continuous use is rated by the manufacturer at about 500° F., about 400° F., and about 500° F. for unfilled PTFE, FEP and PFA, respectively. The thermal conductivities at room temperature of PTFE, FEP and PFA are about 0.25 W/(m° C.), about 0.20 W/(m° C.), and about 0.19 W/(m° C.), respectively. Polyetheretherketone is available, for example, from GE Plastics (Bridgeport, Conn.) and polyamide-imide is commercially available, for example, under the trade name TORLON® from BP Amoco Chemicals, Inc. (Alpharetta, Ga.). Unfilled PEEK has a heat deflection temperature, measured by ASTM test D648 at 1.8 MPa, of about 320° F. and a thermal conductivity of about 0.24 W/(m° C.). Depending upon the specific grade, unfilled TORLON® polyamide-imide is rated with a heat deflection temperature, measured by ASTM test D648 at 1.8 MPa, of between about 532° F. and about 540° F. and with a thermal conductivity ranging between about 0.26 W/(m° C.) and about 0.53 W/(m° C.). The thermally insulating shield 100 may also be formed from a woven substrate or mat of glass fibers.

Ceramics having thermal conductivities suitable for forming the thermally insulating shield 100 include, but are not limited to, mica and various machinable ceramics including the machinable ceramic marketed under the trade name MACOR® by Corning, Inc. (Corning, N.Y.). With regard to possible heat transfer by conduction, the thermal conductivities of mica and MACOR® are about 0.7 W/(m° C.) and about 1.46 W/(m° C.), respectively, at room temperature. By way of comparison, the thermal conductivities of common structural metals are, for example, about 190 W/(m° C.) for 2024-T3 aluminum, about 40 to 70 W/(m° C.) for low carbon steels, about 38 to 46 W/(m° C.) for high carbon steels, and about 14 to 16 W/(m° C.) for 316 stainless steel, all measured at room temperature.

Generally, the primary source of heat flow to the actuator 14 is conductive and radiative transfer from the liquid distribution manifold 16, which depends upon properties of the thermally insulating shield 100 such as thermal conductivity, the thickness or length, and the cross-sectional area, which may be a function of thickness. For conductive thermal paths, the heat flow is proportional to the product of the thermal conductivity and cross sectional area and inversely proportional to the length. For radiative thermal paths, the heat flow is proportional to the emissivity and effective surface area of the thermally insulating shield 100. It is understood that the transfer of heat from the liquid distribution manifold 16 and dispenser body 12 to the actuator 14 will also depend upon other factors including relative temperatures or temperature gradients, the thermal diffusivity and specific heat capacity of the thermally insulating shield 100, the convection coefficients of the liquid distribution manifold 16 and dispenser body 12, and the emissivity, reflectivity, absorptivity and spacing of various non-contacting, line-of-sight surfaces of the liquid distribution manifold 16, dispenser body 12 and actuator 14. The transfer of heat by conduction between contacting portions of the air piston housing 70 and liquid distribution manifold 16 may also be reduced, for example, by intentionally roughening the abutting surfaces of one or both thereof so as to reduce the effective contact area for conductive heat transfer.

Figure 3:
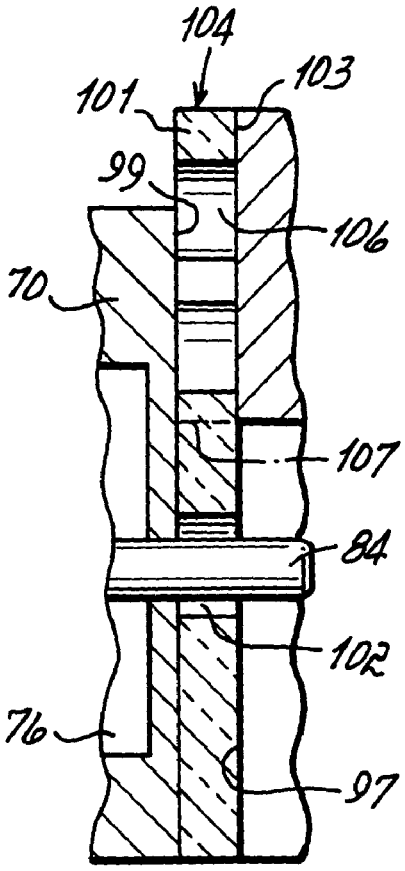
FIG. 3 is a cross-sectional view of a portion of FIG. 2 showing an alternative embodiment of a heat shield constructed in accordance with the invention.
Figure 4A:
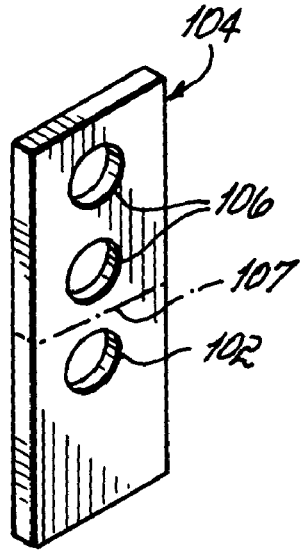
FIGS. 4A–C are perspective views showing alternative embodiments of a heat shield constructed in accordance with the invention.

With reference to FIGS. 3 and 4A and in which like reference numerals refer to like features in FIGS. 1 and 2, the heat transfer from the liquid distribution manifold 16 to the actuator 14 may be reduced by providing a thermally insulating shield 104 constructed as a perforated sheet. The perforations in thermally insulating shield 104 consist of one or more throughbores 106 that extend through the thickness of the material. The throughbores 106 are typically located in a section of the shield positioned between the liquid distribution manifold 16 and the air piston housing 70. The throughbores 106 are typically filled with a gas, such as air, that, assuming still or stagnant air, has a thermal conductivity of about 0.03 W/(m° C.). The thermal conductivity of air is less than the thermal conductivities of most ceramics and polymers, such as those described above. In addition, the heat transfer is minimized if the air is kept still or stagnant such as by limiting convective air currents. To that end, the throughbores 106 may be substantially enclosed spaces having a closed boundary that does not intersect the periphery of the thermally insulating shield 104. It follows that the effective thermal conductivity of the thermally insulating shield 104 is less than the thermal conductivities of common structural metals used to form air piston housing 70. The thermally insulating shield 104 may be truncated, as indicated by dashed line 107 in FIG. 4A, to omit the portion of shield 104 containing the shaft opening 102.

Figure 4B:
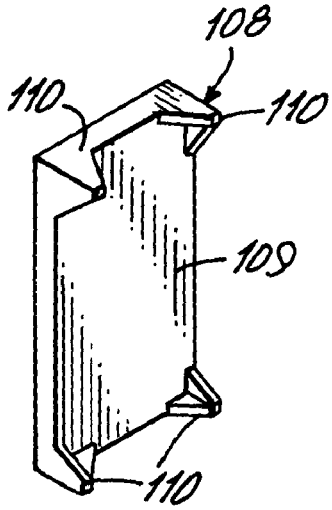

With reference to FIG. 4B and according to another embodiment of the shield of the present invention, the heat transfer from the liquid distribution manifold 16 to the air piston housing 70 of the actuator 14 may be reduced by providing a thermally insulating shield 108. The thermally insulating shield 108 includes a rectangular panel 109 having a plurality of, for example, four projections 110, such as posts or legs, that space the shield apart from the liquid distribution manifold 16. The projections 110 are located in a section of the thermally insulating shield 108 positioned between the liquid distribution manifold 16 and the air piston housing 70. The only points of contact between the shield 108 and the facing surface 97 (FIG. 3) of the liquid distribution manifold 16 are the extremities or tips of the projections 110. The panel 109 covers the portion of surface 99 (FIG. 3) that confronts surface 97 of the liquid distribution manifold 16 and the dispenser body 12 for reducing the transfer of heat.

Each projection 110 has a cross-sectional area, viewed parallel to the surface normal of panel 109, that is significantly less than the cross-sectional area of panel 109 and that varies along the length or thickness thereof. The projections 110 are illustrated in FIG. 4B with a taper that increases in a direction from the tip to the junction with panel 109. However, each projection 110 may have a uniform or non-uniform cross-section along its length, a cross-section that is uniformly tapered or non-uniformly tapered, or a taper that decreases in a direction from the tip of projection 110 to the junction with panel 109. In addition, the thermally insulating shield 108 may be positioned with panel 109 abutting surface 97 and the tips of projections 110 contacting surface 99. The projections 110 could also have a cross-section, for example, rectangular, elliptical or oval, that differs from the right-angle, L-shaped cross-section illustrated in FIG. 4B.

Figure 4C:
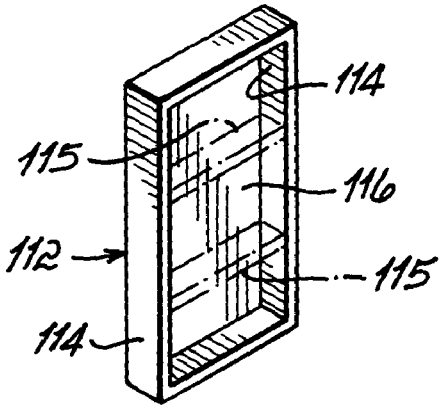

With reference to FIG. 4C and according to another embodiment of the shield of the present invention, the heat transfer from the liquid distribution manifold 16 to the air piston housing 70 of the actuator may be reduced by providing a thermally insulating shield 112 constructed as a thin-walled spacer. The thermally insulating shield 112 includes a sidewall 114 formed from a thin-walled material. The thermally insulating shield 112 has a substantially rectangular cross-sectional profile viewed normal to the centerline of the shield 112, although the present invention is not so limited. The reduced cross-sectional area of the sidewall 114 minimizes the path available for conductive heat transfer through the thermally insulating shield 112, as compared with an imperforate layer such as shield 100. Further, the enclosed space 116 defined between the air piston housing 70 and the liquid distribution manifold 16 and the side wall 114 is filled with air, or other gas, having a low thermal conductivity relative to most structural metals, such as those described above. The heat transfer is further minimized because the air in the enclosed space 116 is substantially still or stagnant and convective currents are reduced.

In other embodiments, the thermally insulating shield 112 may be divided into a plurality of cells or chambers by one or more thin-walled dividers 115 positioned within the interior of the sidewall 114 and interconnecting various portions of the sidewall 114. The compartmentalization of the interior of the sidewall 114 provides additional thermal insulation by reducing the transfer of heat through radiative transfer and convection. The dividing walls 115 may have other arrangements such as a honeycomb with cells of any suitable geometrical configuration, such as hexagon, square, triangular, and the like. The presence of dividing walls 115 also provides additional structural support while continuing to present a reduced cross-sectional area for conductive heat transfer from the liquid distribution manifold 16 to the air piston housing 70.

The thermally insulating shields 104, 108, and 112 shown in FIGS. 4A–C may be formed of any suitable ceramic or a polymer, such as those described above with relation to shield 100, having thermal properties, such as a relatively-low thermal conductivity, effect to reduce the transfer of heat from the liquid distribution manifold 16 and the dispenser body 12 to the actuator 14. In addition, the thermally insulating shields 104, 108, and 112 may each be formed of a metal, such as a stainless steel, having a relatively low thermal conductivity compared with other metals, such as 2024-T3 aluminum. The effective thermal properties of thermally insulating shields 104, 108, and 112 will be determined by the composite thermal properties, such as thermal conductivity, of the material or materials forming them and the physical characteristics, such as cross-sectional area, of the corresponding structures. It is understood that any of the thermally insulating shields 100, 104, 108, or 112 may be formed as one-piece, unitary constructs or may be formed of multiple components assembled together with conventional fasteners or by adhesive bonding. In those embodiments that consist of multiple components, the thermally insulating shields 100, 104, 108, or 112 may be assembled from individual components of differing composition.

During operation, any one of the thermally insulating shields 100, 104, 108, and 112 prevents or reduces the transfer, especially by thermal conduction, of heat from the liquid distribution manifold 16 to the actuator 14. Since the present invention prevents or significantly reduces the heating of the actuator 14, the solenoid valve 71 may be directly connected to the air piston housing 70 without being adversely affected by transferred heat. The direct connection between the solenoid valve 71 and the air piston housing 70 may include an intervening seal or gasket (not shown) so that actuation air does not leak between the confronting and abutting surfaces thereof. Rapid operation of the stem assembly 50, manifested by rapid or short cycle times, can contribute a suctioning or suck-back effect at the end of each dispensing cycle which helps to prevent accumulation, stringing or drooling of excess heated liquid at the discharge outlet 39. The effectiveness of rapid cycle times for producing the suck-back effect is described in commonly-assigned U.S. Pat. No. 6,164,568 entitled "Device for Applying Free-flowing Material to a Substrate, in Particular for Intermittent Application of Liquid Adhesive." The disclosure of this patent is hereby incorporated by reference herein in its entirety.

The thermally insulating shield, selected from among thermally insulating shields 100, 104, 108, and 112, is typically configured such that the operating temperature of the solenoid valve 71 is less than about 225° F. In other embodiments, the thermally insulating shield, selected from among thermally insulating shields 100, 104, 108, and 112, is configured such that the operating temperature of the solenoid valve 71 is less than about 140° F. so that valve 71 does not require high-temperature seals, which further improves the achievable cycle times and permits faster operation of the liquid dispensing module 10. The reduced transfer of heat from the dispenser body 12 and the distribution manifold 16 has an addition benefit in that the operational lifetime of the solenoid valve 71 is significantly increased by the lowering of the operating temperature.

Figure 5:
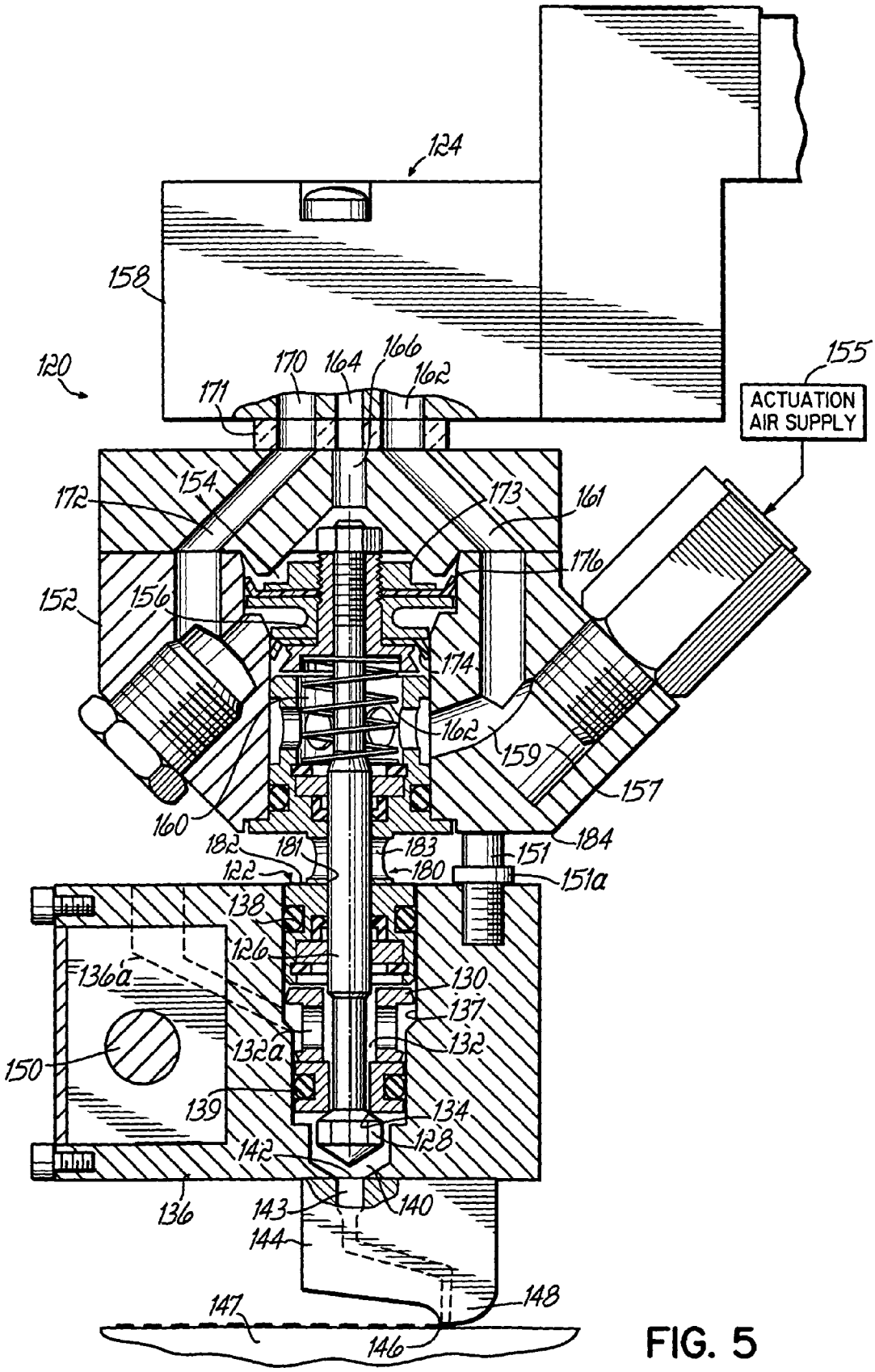
FIG. 5 is a cross-sectional view of a liquid dispensing module constructed in accordance with the invention.
Figure 6:
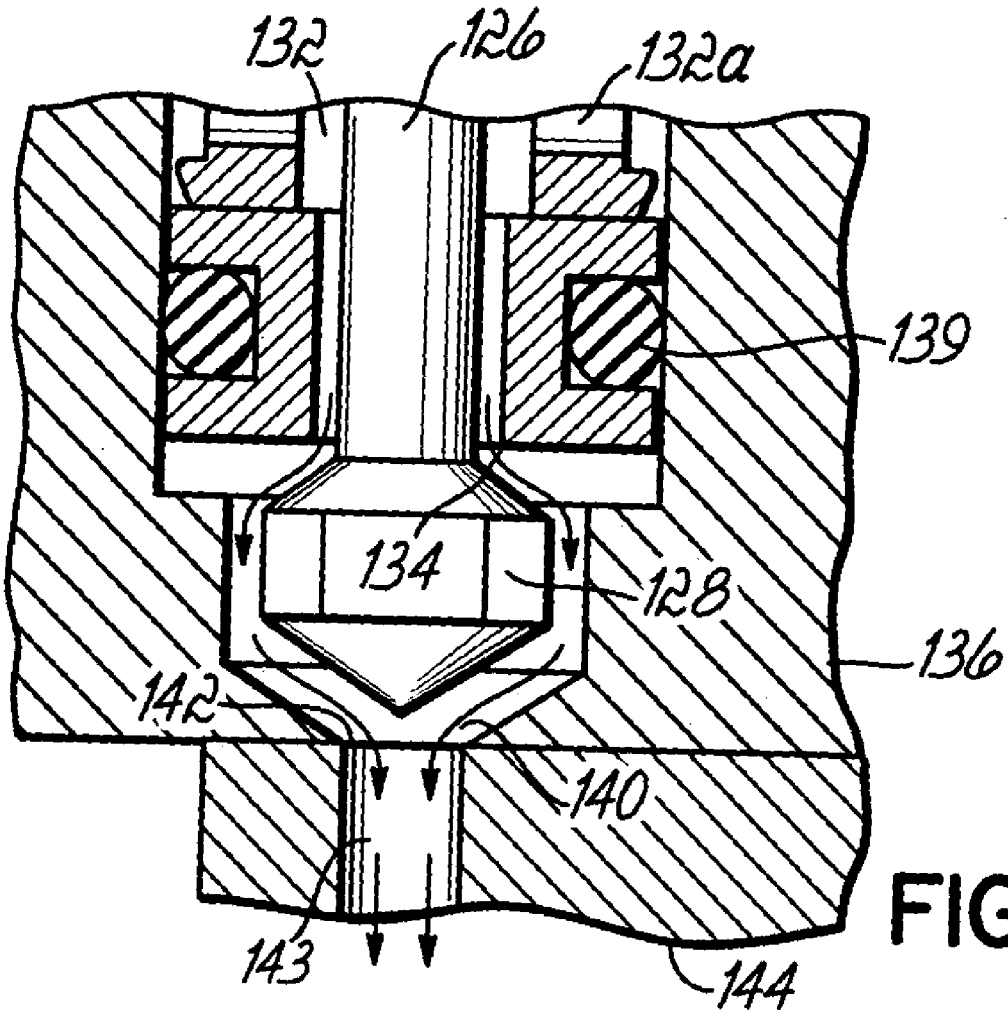
FIG. 6 is a cross-sectional view of a portion of the liquid dispensing module of FIG. 5 showing the dispensing module in an open position.

With reference to FIGS. 5 and 6, a liquid dispensing module 120 constructed in accordance with the principles of the present invention includes a dispenser body 122 and an actuator 124. The liquid dispensing module 120 is specifically adapted for dispensing a heated liquid, such as a molten thermoplastic hot melt adhesive. In particular, the liquid dispensing module 120 is configured to be actuated between an open position (FIG. 6), in which heated liquid is dispensed, and a closed position (FIG. 5), in which the flow of heated liquid is discontinued. The dispenser body 122 is substantially similar to the dispenser body disclosed in U.S. Pat. No. 6,164,568, which was incorporated by reference above in its entirety, and operates in a substantially similar manner for cycling between the open and closed positions of the liquid dispensing module 120.

The dispenser body 122 includes an elongated valve stem 126, a valve plug 128 mounted at one end of the valve stem 126, and a flow-directing insert 130 having a supply channel 132 and a valve seat 134. The flow-directing insert 130, a portion of the valve stem 126, and the valve plug 128 are received within a stepped-diameter bore 137 formed within a liquid distribution manifold 136 having a flow passageway **136*a* for directing a flow of heated liquid to the supply channel 132. The valve stem 126 and valve plug 128 are linearly movable relative to the valve seat 134 for providing an open position (FIG. 6) by creating an annular opening between the plug 128 and seat 134 and a closed position (FIG. 7) by engaging the plug 128 with seat 134. The flow-directing insert 130 includes a pair of seals 138 and 139 positioned in respective ones of a spaced-apart pair of circumferential glands. An inlet 132*a* of the supply channel 132 is fluidically coupled with flow passageway 136*a*. The supply channel 132 includes a chamber 140 into which the valve plug 128 extends and an outlet 142 through which heated liquid flows into a passageway 143 in a nozzle 144. The nozzle 144 has an elongated discharge outlet 146 formed in a mouthpiece 148. The discharge outlet 146 is fluidically coupled with passageway 143 for dispensing the heated liquid onto a substrate 147**.

The liquid distribution manifold 136 includes a heater 150 that converts electrical energy into heat energy for heating manifold 136. The heater 150 is controlled by a heater controller (not shown), which may rely on feedback from a temperature sensor (not shown) for regulating the electrical power provided to heater 150. The liquid distribution manifold 136 also heats the dispenser body 122 by heat transfer so that heated liquid within body 122 is maintained at a desired application temperature. A stud 151 provides an additional mechanical interconnection with liquid distribution manifold 128 for securing the actuator 124 to the manifold 136.

With continued reference to FIGS. 5 and 6, the actuator 124 includes a two-piece air piston housing 152, an air cavity 154, an air piston 156 attached to an end of the valve stem 126 opposite the end carrying valve plug 128, and a solenoid valve 158. The air piston housing 152 has an inlet passageway 157 that is adapted to be fluidically coupled with an actuation air supply 155. The inlet passageway 157 includes a first channel 159 leading to an air chamber 160 of an air spring return and a second channel 161 that leads to a supply duct 162 of the solenoid valve 158. The air chamber 160 surrounds a portion of the valve stem 126. A biasing element 162, illustrated in FIG. 5 as a compression coil spring, is positioned in the air chamber 160 and helically surrounds the portion of the valve stem 126 in chamber 160.

The solenoid valve 158 has an access duct 164 in fluid communication with an air passageway 166 in the air piston housing 152. The air passageway 166 leads to air cavity 154, which has a variable air volume that is a function of the position of the air piston 156. The solenoid valve 158 also has an exhaust duct 170 which is fluidically coupled with an exhaust passageway 172 in the air piston housing 152. When the access duct 164 is in fluid communication with the first channel 159 of the inlet passageway 157, pressurized actuation air is provided through the air passageway 166 to the air cavity 154. When the access duct 164 is in fluid communication with the exhaust duct 170, pressurized actuation air is exhausted from the air cavity 154 via air passageway 166. When the air pressure in the air cavity 154 is at 0 p.s.i.a., the liquid dispensing module 120 is in a closed position and the air cavity 154 has its minimum air cavity volume. Solenoid valve 158 is similar in construction to solenoid valve 71.

With continued reference to FIGS. 5 and 6, the air cavity 154 has an initial air volume, including the volume of access duct 164 and air passageway 166, when the liquid dispensing valve 120 is in the closed position. Solenoid valve 158 is attached to the air piston housing 152. A thin intervening thermal-insulating barrier 171 is positioned between the air piston housing 152 and the solenoid valve 158. Thermal-insulating barrier 171 provides a seal that prevents leakage of actuation air between the air piston housing 152 and the solenoid valve 158. Passageways are provided in thermal-insulating barrier 171 that join second channel 161 with supply duct 162, access duct 164 with air passageway 166, and exhaust duct 170 with exhaust passageway 172. At least partially as a result of the direct attachment between the solenoid valve 158 and the air piston housing 152, the initial air volume of the air cavity 154 may be reduced to a value less than about 2170 $mm^3$ and, in particular, less than about 1500 $mm^3$. The reduction in the initial air volume of the air cavity 154 reduces the time required to pressurize the air cavity 154 to an air pressure effective to overcome stiction and initiate movement of the air piston 156.

The air piston 156 has a first face 173 of a first effective surface area that is exposed to the environment within the air cavity 154. When pressurized air is applied to the air cavity 154, an actuation force is applied to the air piston 156 given by the product of the air pressure within air cavity 154 and the first effective area of the first face 173. The air piston 156 has a second face 174 of a second effective area that is exposed to the pressurized air within the air chamber 160. The effective area of the second face 174 is significantly less than the effective area of the first face 173 so that the force applied to first face 173 exceeds the force applied to the second face 174 as the air pressure in air cavity 154 increases. As a result, the air piston 156 moves when the solenoid valve 158 applies a sufficient air pressure of actuation air to the air cavity 154. The air piston 156 has a first seal 176 that seals the first face 173 with the inner wall of the air cavity 154 and a second seal 177 that seals the second face 174 with the inner wall of the air chamber 160.

With continued reference to FIGS. 5 and 6, a spacer 180 separates the air piston housing 152 from the dispenser body 122 and the liquid distribution manifold 136. Valve stem 126 projects through a central throughbore 181 in spacer 180. A throughbore 183 extends through transversely through the thickness of the spacer 180 and is aligned orthogonal to the central throughbore 181. The presence of throughbore 183 reduces the effective cross-sectional area of the spacer 180 averaged over the distance between a face 182 of the dispenser body 122 and a confronting face 184 of air piston housing 152, which is substantially equal to the length of the spacer 180. The average effective cross-sectional area of the spacer 180 is less than the surface area of either face 182 or face 184, which would otherwise be in abutting contact if spacer 180 were not intervening. The reduced effective cross-sectional area of the spacer 180 contributes to reducing the conduction of heat from face 182 to face 184. The spacer 180 cooperates with the thermal-insulating barrier 171 to thermally isolate the solenoid valve 158 against the transfer of heat from the liquid distribution manifold 136 and the dispenser body 122.

According to one aspect of the present invention, the pneumatic actuator of a liquid dispensing module, such as dispensing module 10 or dispensing module 120, may be modeled to predict characteristics of the dispensing module. In particular, the physical behavior of a pneumatically-actuated liquid dispensing module may be approximated by generating a description of the liquid dispensing module and the physical laws controlling the physical properties of the liquid dispensing module, formulating an equation of motion governing the description, and solving the equation of motion to simulate the performance of the liquid dispensing module as a function of time. Input parameters may be varied in the simulation to study their effect upon the approximated physical behavior. A model liquid dispensing module includes a valve stem having an air piston at one end of an elongated cylindrical rod and a spherical sealing ball at the opposite end, an annular valve seat, a cylindrical stem guide through which the stem travels, a spring return operatively coupled with the valve stem, a nozzle having a discharge orifice, and a solenoid valve regulating or switching the flow of air pressure to an air cavity in which the air piston is disposed for movement. According to Newton's second law, a suitable equation of motion describing the movement of the valve stem in the model liquid dispensing module is given by:

$$M \cdot \frac{d^2}{dt^2}x = F_{spring}(x) + F_{friction}(x) + F_{hydraulic}(x, v) + A_p \cdot P(x, v) + F_{stop}(x, v, P)$$

where x, v and $dx^2/dt^2$ are, respectively, the displacement, linear velocity and the acceleration of valve stem, t is the time, and the terms on the right hand side of the equation are the total forces acting on the valve stem of mass, M. The physical system describing the liquid dispensing module is nonconservative due to the inclusion of frictional forces.

$F_{spring}(x)$ is the force applied by the spring return to the valve stem to maintain the liquid dispensing module in the closed position in opposition to the hydraulic force applied by the heated liquid and to retract the valve stem to provide the closed position when air pressure is removed from an air cavity in which the air piston is positioned.

$$F_{spring}(x) = -[k \cdot (x_0 + x \cdot \text{in}) + f_{air}]$$

in which k is a spring constant characteristic of the spring return mechanism, $x_0$ is an initial displacement that offsets the hydraulic force, x is the displacement of the spring measured in inches (in), and $f_{air}$ is a term that quantifies an air return force that may optionally supplement the spring return force.

$F_{hydraulic}(x)$ is the hydraulic force acting on the valve stem assembly and is given by:

$$F_{hydraulic}(x, v) = -\Delta P_{fin}(x, v) \cdot \pi \cdot \frac{D_s^2}{4} + -\Delta P_{fout}(x, v) \cdot \pi \cdot \frac{D_n^2 - D_s^2}{4}$$

where $D_n$ is the diameter of the valve stem, and $D_s$ is the diameter of the valve seat. The pressure inside the seating circle and the pressure outside the seating circle, $\Delta P_{fin}$ and $\Delta P_{fout}$, are given by:

$$\Delta P_{fin}(x, v) := \left[PP \cdot \left(\frac{Rn}{Rn + Rs(x) + Ra}\right) + (Qdrag(v) + QdOu(v)) \cdot \left(\frac{Rn \cdot Ra}{Rn + Rs(x) + Ra}\right)\right] + QdIn(v) \cdot \left[\frac{Rn \cdot (Rs(x) + Ra)}{Rn + Rs(x) + Ra}\right]$$

$$\Delta P_{fout}(x, v) := \Delta P_{fin}(x, v) \cdot \left(\frac{Rs(x) + Rn}{Rn}\right) - QdIn(v) \cdot Rs(x)$$

in which PP is the pump pressure and $R_n$, $R_s(x)$, and $R_a$, QdIn(v) and QdOut(v) are described below.

The flow characteristic of the system depends principally upon the rheology of the fluid and on the geometry of the valve assembly. The flow characteristic may be simulated using laminar Newtonian flow as a series of resistances generated by tubular and annular passages. The nozzle is approximated by a tubular or slotted discharge outlet and the seat is modeled as an annulus in which the inner diameter approaches the outer diameter when the valve is closed. The area between the insert and the stem is modeled as an annular opening.

Rn is the flow resistance of a slot nozzle given by:

$$Rn := \frac{12 \cdot \mu \cdot Ln}{W \cdot rn^3}$$

in which $L_n$ is the thickness of a nozzle shim, μ is the viscosity of the dispensed fluid in p.s.i-seconds, W is the nozzle length, and $r_n$ is the radius of the discharge orifice.

$R_s(x)$ is flow resistance in an annular area of the valve seat given by:

$$Rs(x) := \begin{cases} 10^{14} \cdot \frac{\text{psi} - \text{sec}}{\text{in}^3} & \text{if } (x \le 0) \\ \frac{8 \cdot \mu \cdot Lb}{\pi \cdot rbs^4 \cdot f\kappa s(x)} & \text{otherwise} \end{cases}$$

in which $r_{bs}$ is radius of the contact area between the spherical sealing ball and valve seat, fκs(x) is a dimensionless number relating the radius of the spherical sealing ball, $r_b(x)$ that is a function of x, and the radius of the ball and seat contact area, $r_{bs}$, and κs is the arithmetic ratio of $r_b(x)$ to $r_{bs}$. $r_b(x)$ is a function of x, which is equal to rs when the valve is fully open and is equal to rbs when the valve is closed, is given by:

$$rb(x) := \left(\frac{Lb - x \cdot in}{Lb}\right)^2 \cdot (rbs - rs) + rs$$

in which Lb is the length of the critical annular region between the ball and valve seat at closing and, fκs (x) is given by:

$$f\kappa s(x) := \begin{cases} 1 \text{ if } \kappa s(x) \le 0 \\ \left[(1 - \kappa s(x)^4) - \frac{(1 - \kappa s(x)^2)^2}{\ln\left(\frac{1}{\kappa s(x)}\right)}\right] & \text{otherwise} \end{cases}$$

$R_a$ is the sum of the flow resistances in the annular region between the stem and guide, $R_{as}$, the hose resistance, $R_h$, and the fitting resistance, $R_t$, given by:

$$Ras := \frac{8 \cdot \mu \cdot La}{\pi \cdot ro^4 \cdot f\kappa}$$

$$Rh := \frac{8 \cdot \mu \cdot Lh}{\pi \cdot rh^4}$$

$$Rt := \frac{8 \cdot \mu \cdot Lt}{\pi \cdot rt^4}$$

in which $L_a$ is the length of the stem guide annulus, $r_o$ is the radius of the stem guide, $L_h$ is the length of the upstream hose, $r_h$ is the radius of the upstream hose, $L_t$ is the length of the upstream fitting, $r_t$ is the radius of the upstream fitting, and fκ(x) is a dimensionless number relating the radius of the valve stem, $r_s$, and the radius of the stem guide, $r_o$, given by:

$$f\kappa := \left[(1 - \kappa^4) - \frac{(1 - \kappa^2)^2}{\ln\left(\frac{1}{\kappa}\right)}\right]$$

in which κ is the arithmetic ratio of $r_s$ to $r_o$.

Flow in the model system is driven by a pump supplying pressurized fluid to a liquid input of the valve assembly and contributions due to the movement of the stem. The pump is modeled as a constant pressure source operating at pressure PP. The stem causes a drag flow and a displacement flow. The displacement flow is the area of the stem that is displacing fluid times the stem velocity. The displacement flow is divided into a portion that originates inside the seating circle, QdIn, and a portion that originates outside the seating circle, QdOut. As the stem closes on the seat, only the portion inside the seating circle will flow out of the nozzle. The drag flow is caused by the fluid in contact with the stem that moves with the velocity of the stem. With no other flows present, this will cause a linear velocity profile so that, on average, the fluid in the annulus will be moving at half the stem velocity. This contribution will be constant despite other superimposing flows.

The displacement flow inside the seating circle is given by:

$$QdIn(v) := \pi \cdot rbs^2 \cdot v \cdot \frac{\text{in}}{\text{sec}}$$

The displacement flow outside the seating circle is given by:

$$QdQut(v) := \pi \cdot (rs2^2 - rbs^2) \cdot v \cdot \frac{\text{in}}{\text{sec}}$$

in which rs2 is the radius of the valve stem outside of the valve seat.

The drag flow is given by:

$$Qdrag(v) := \frac{ro - rs}{2} \cdot \pi \cdot 2 \cdot \left(\frac{ro + rs}{2}\right) \cdot v \cdot \frac{\text{in}}{\text{sec}}$$

Outside the seating circle, the stem drags with it:

$$Qdrag(v) := v \cdot \frac{\text{in}}{\text{sec}} \cdot \frac{\pi}{2} \cdot (ro^2 - rs^2)$$

$F_{friction}(x)$ is the sum of the frictional forces acting at the sealing interfaces in the air piston cavity and the various hydraulic and pneumatic seals of the valve assembly. Although the precise mathematic description of the friction acting at these points in the structure of the valve assembly is unknown, certain mathematical approximations may be incorporated into the model. Specifically, two types of friction are included in the model, namely viscous drag and coulomb friction with a static friction and a μ-slip characteristic. Viscous drag opposes the motion of the valve stem and is proportional to the relative speed between the seal and the moving element. Coulomb friction is a constant force that always opposes the direction of motion and decreases as the speed of the valve stem increases. The Coulomb friction can vary with the valve stem's direction of motion. When the velocity is zero and the valve stem is not against a stop, the friction is considered to balance the air, hydraulic and spring forces. The three sources of friction are lumped together as one friction force, $F_{friction}(x)$, which is a function of position, velocity and air pressure given by:

$$F_f(x, v, P) := \begin{cases} -F_r(x, v, P) \text{ if } (F_r(x, v, P) < F_s)\cdot(0 < x < x_{max}) \\ -F_s \cdot \dfrac{F_r(x, v, P)}{|F_r(x, v, P)|} \text{ if } (|F_r(x, v, P)| \geq F_s)\cdot(0 < x < x_{max}) \\ 0\cdot\text{lbf if } x \geq x_{max} \\ 0\cdot\text{lbf if } x \leq 0 \\ \left[b\cdot\dfrac{(F_s - F_d)}{b + |v|\cdot\frac{\text{in}}{\text{sec}}} + F_d\right]\cdot\dfrac{-v}{|v|} + Co\cdot -v \text{ if } v > 0.01 \\ \left[b\cdot\dfrac{(F_s - F_d)}{b + |v|\cdot\frac{\text{in}}{\text{sec}}} + F_d\right]\cdot\dfrac{-v}{|v|} + Cc\cdot -v \text{ if } v < -0.01 \end{cases}$$

where the position of the valve stem ranges from x=0 to $x=x_{max}$, $C_0$ and $C_c$ are viscous drag coefficients, b is a constant that sets the "steepness" of the μ-slip characteristic when it transitions from a static friction condition to a dynamic friction condition, $F_s$ and $F_d$ are coefficients of static and dynamic friction, respectively, and $F_r(x, v, P)$ is given by:

$$F_r(x,v,P):=F_{spring}(x)+F_{hydraulic}(x,v)+A_p\cdot(P-14.7)\cdot\text{psi}$$

in which $F_{spring}(x)$, $F_{hydraulic}(x,v)$, and P are described above and $A_p=(\Pi/4)\cdot(D_p)^2$ where $D_p$ is the diameter of the air piston exposed to the air pressure in the air cavity.

As the pressurized air is provided to the air cavity, the volume of the air cavity changes as a function of the displacement of the air piston. The pressure change in the air cavity is derived from the ideal gas law and is given by:

$$dP(x, v, P) := \frac{R_g\cdot T\cdot Qair(P1, P2, Cv) - P\cdot psi\cdot A_p\cdot v\cdot\frac{\text{in}}{\text{sec}}}{V_0 + A_p\cdot x\cdot\text{in}}\cdot\frac{\text{sec}}{psi}$$

where $$Qair(P1, P2, Cv) = \begin{cases} \text{if } P2 > P1 \\ \quad \begin{cases} p \leftarrow P1 \\ P1 \leftarrow P2 \\ P2 \leftarrow p \\ s \leftarrow 1 \end{cases} \\ s \leftarrow -.5 \text{ otherwise} \\ P2 \leftarrow .5\cdot P1 \text{ if } P2 < .5\cdot P2 \\ Q \leftarrow s\cdot Cv\cdot\sqrt{\dfrac{(P1\cdot psi)^2 - (P2\cdot psi)^2}{T\cdot SG}}\cdot Const \\ Q \end{cases}$$

in which $R_g$ is the universal gas constant, P1 is the air pressure when the solenoid is on and is reduced to a dimensionless term as (Pon/psi), P2 is the air pressure when the solenoid is off and is reduced to dimensionless terms as (Poff/psi), SG is the specific gravity of the pressurized gas (SG=1 for air), v is the velocity and $V(x)=V_0+A_p\cdot x\cdot\text{in}$ is the volume of the air cavity as a function of displacement, x, in inches in which $V_0$ is the initial air volume of the air cavity before the cavity is filled with an air pressure sufficient to overcome stiction for moving the air piston and $A_p$ is described above. $C_v$ is the effective valve flow coefficient of the pneumatic actuator, which may be less than or equal to the ideal valve flow coefficient of the solenoid valve. The above definition of $Q_{air}$ is consistent with a standard $C_v$ relationship recommended by the Fluid Controls Institute in standard FCI 68-1-1998 entitled "Recommended Procedure in Rating Flow and Pressure Characteristics of Solenoid Valves for Gas Service," which is hereby incorporated by reference herein in its entirety. The air cavity is partitioned by the presence of the air piston. The initial volume of the air cavity includes only portions of the air cavity capable of receiving pressurized air and, thereby, capable of applying an actuation force to the air piston equal to the product of the air pressure and exposed surface area of the air piston.

At the extrema or end points of its range of motion, the valve stem needle abuts against the seat or, at the top of its stroke, against the valve body so that reaction forces are developed on the valve stem and the valve remains in equilibrium. The reaction forces only act when the valve stem abuts the stops and the force at each end operates in only one direction. Specifically, the reaction force due to the seat at x=0 acts in one direction and the reaction force provided by the valve body at $x=x_{max}$ acts in the opposite direction. The reaction force, $F_{stop}$, is given by:

$$F_{stop}(x, v, P) := \begin{cases} -|F_r(x, v, P)| & \text{if } (x \geq x_{max})\cdot(F_r(x_{max}, v, P) \geq 0)\cdot(v \geq 0) \\ |F_r(0, v, P)| & \text{if } (x \leq 0)\cdot(F_r(0, v, P) \leq 0)\cdot(v \leq 0) \\ 0\cdot\text{lbf} & \text{otherwise} \end{cases}$$

The description of the liquid dispensing module and the physical laws controlling the physical properties of the liquid dispensing module is implemented by software on a suitable electronic computer to solve the equation of motion and, thereby, to approximate the physical performance of the actual physical system represented by the liquid dispensing module. Specifically, the equation of motion is solved using known numerical analysis techniques, such the Runge-Kutta method, implemented in a software application such as MATHCAD® (Mathsoft, Inc., Cambridge, Mass.). The software application resides on a suitable electronic computer or microprocessor, which is operated so as to perform the physical performance approximation. However, other numerical methods are contemplated by the present invention. Alternative descriptions of the liquid dispensing module are contemplated by the present invention and would encompass ordinary or partial differential equations, integral equations, integrodifferential equations, and other expressions known to those skilled in the art. The software application MATHCAD® internally converts all units to a common or consistent set of units, such as SI metric units or English units, as understood by a person of ordinary skill in the art.

A set of initial conditions is defined by assigning initial values to the variables (i.e., x (t=0)=0, dx/dt (t=0)=0, etc.) and assigning numeric values to the constants. The equations are then solved numerically to calculate a total cycle time for the simplified valve assembly to transition from a closed position to an open position and, thereafter, to retract or withdraw to the closed position. The step size for the calculation is chosen small enough to ensure sufficient accuracy of the result. For the present calculations, the time for completing one total cycle is divided into, for example, about 1000 discrete time steps.

The initial conditions for one typical simulation are as follows:

$x_{max}$=0.012·in $K$=4.883·Nt/mm $M$=8.8·g $X_O$=2.6·mm (0.102 in.)

$Ds$=4·mm $Dn$(=2 $r_{bs}$)=4·mm $Dp$=20·mm $PP$=300·psi $M$=12·poise

ρ=0.9·g/cm$^3$ $Ln$=4·mm $W$=40·mm $R_n$=0.006·in $L_b$=0.3·mm (0.012·in)

$r_{bs}$=2·mm (0.079·in)

$r_s$=1.5·mm $L_a$=5·mm $r_o$=2·mm $r_{s2}$=3·mm $L_b$=0.3·mm $L_h$=6·ft $r_h$=3/16·in $L_t$=2·in $r_t$=1/16·in $b$=0.05·in/sec $C_o$=0.2·lb/ft $C_c$=0.2·lb/ft $F_s$=3·lb/ft $F_d$=0.001·lb/ft $T$=(70+460)·$R$ $V_o$=0.046·in$^3$ $P$=114.7·psi $Pon$=(75+14.7)·psi $f_{air}$=109.2·Nt $C_v$=0.21

$V_o$=748·mm$^3$

Figure 7:
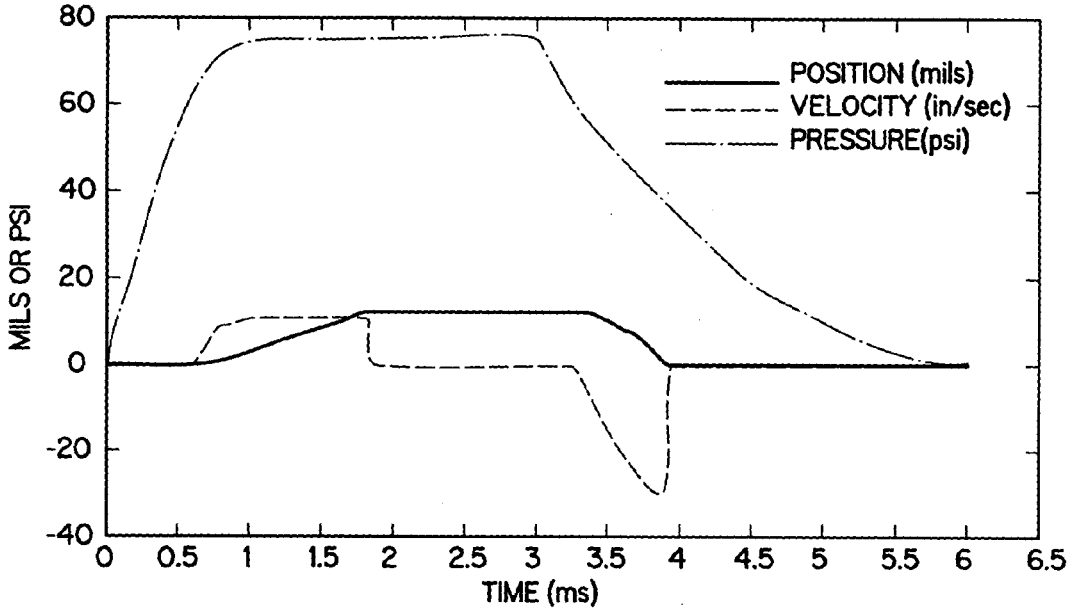
FIG. 7 is a graphical representation of the calculated displacement and velocity of a model liquid dispensing module as a function of air pressure in the air cavity.

With reference to FIG. 7, a graphical representation is provided of the air pressure applied to the air cavity and the position and velocity of the valve stem, which have been numerically calculated by the simulation as respective functions of time. The numerical calculation was performed by application of the Runga-Kutta method to the model described herein and for the set of initial conditions provided above.

As is apparent from FIG. 7, the air pressure in the air cavity monotonically increases or ramps from 0 p.s.i. toward its maximum value of about 75 p.s.i. over the initial 0.6 milliseconds of the calculation. During this initial interval, the air piston remains stationary or at rest because the stiction of the valve stem and air piston exceeds the force applied to the air piston by the pressurized air. When the applied force is sufficient to overcome stiction in the model system, the air piston accelerates from rest over the interval between about 0.6 milliseconds and about 0.8 milliseconds to attain a constant velocity. Over the interval in which the air piston is moving with constant velocity and during which the air pressure is constant, the position or displacement of the air piston and valve stem is increasing linearly. At a time of about 1.8 milliseconds, the maximum displacement of the air piston and valve stem occurs at $x_{max}$ when the valve stem is displaced to the position of the stop. The system is maintained in the open position for an arbitrary dispensing time, which is illustrated, without limitation, in FIG. 7 as a dispensing time of about 1.2 milliseconds. At about 3 milliseconds, the exhaust of air pressure from the air cavity initiates. As the air pressure decreases, the actuation force acting on the air piston and the valve stem decreases until the force is no longer sufficient to withstand the opposing force applied by the spring return and the air return force supplementing the spring return force. Initiating at about 3.3 milliseconds, the air piston begins to move with an approximately linear acceleration as the valve stem retracts toward the closed position. The motion of the air piston and valve stem halts abruptly at about 4 milliseconds when the valve stem strikes the other of the stops and instantaneously decelerates to rest back in the closed position. The air pressure is exhausted from the air cavity over the next 2 milliseconds to return to an air pressure of 0 p.s.i. at a time of about 6 milliseconds. The simulated total cycle time for a single cycle from a closed position to an open position and return, subtracting the arbitrary 1.2 millisecond dispensing time, is about 4.8 milliseconds for an initial volume of the air cavity of $V_0$=748·mm$^3$ and an effective valve flow coefficient of $C_v$=0.21.

As the result of a series of simulation similar to the simulation illustrated in FIG. 7, it has been determined that the initial volume of the air cavity, $V_0$, and the effective valve flow coefficient, $C_v$, are the parameters upon which the total cycle time has the most significant dependence. A lesser dependence for the cycle time is noted, for example, with regard to the mass of the air piston. The initial volume and effective valve flow coefficient are variables best adjusted in order to optimize the total cycle speed to permit rapid operation of the simplified valve assembly. Generally, smaller relative initial volumes in combination with larger relative effective valve flow coefficients minimize the cycle time. The results of the simulations can be implemented in the solenoid valves and air cavities of actual liquid dispensing modules in order to reduce the cycle time. If, for example, the initial air volume of the air cavity is known, the ideal flow coefficient of a solenoid valve can be selected in accord with the effective valve flow coefficient from the results of the calculation to provide, for example, a cycle time of 5 milliseconds or less. The initial volume of the air cavity excludes any change in the volume of the air cavity due to movement of the air piston and the cycle time excludes the switching time of the solenoid valve. Typically, the change in the volume of the air cavity is negligible relative to the initial air volume.

Figure 8:
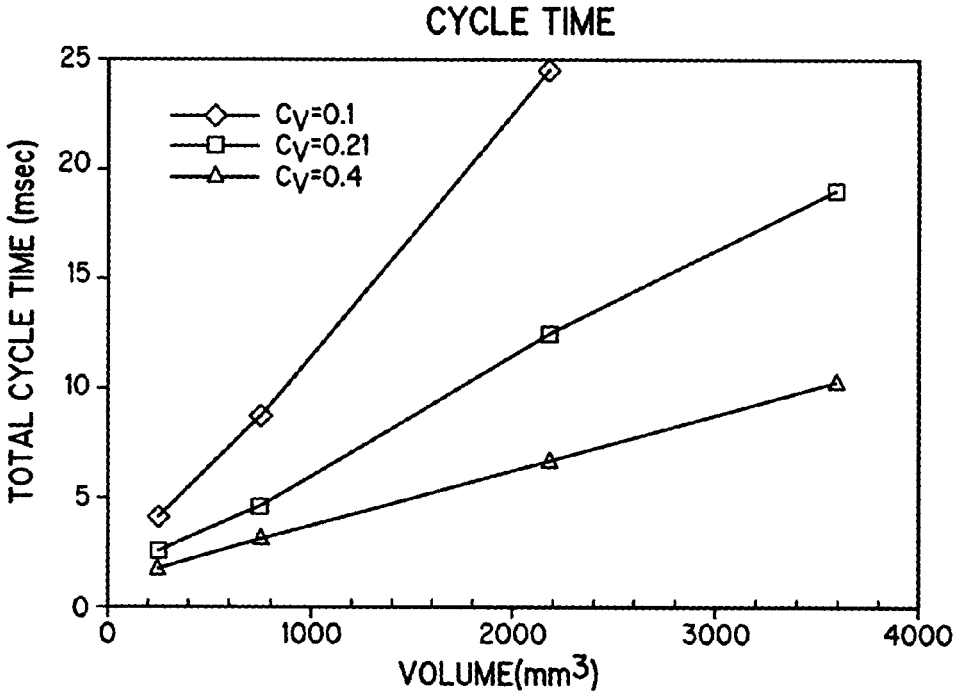
FIG. 8 is a graphical representation of the cycle time of a model liquid dispensing module as a function of the effective valve flow coefficient and the air cavity volume.

With reference to FIG. 8, one aspect of the present invention can be demonstrated by a graphical representation of the total cycle time as a function of the initial volume of the air cavity for various values of effective valve flow coefficient. The data points, through which the curves are drawn, represent the simulated total cycle time, calculated as indicated above, in which the values of the initial volume and the effective valve flow coefficient are the only initial conditions varied among the different calculations. It is apparent from FIG. 8 that, for any given value of the effective valve flow coefficient, the cycle time is approximately a linear function of the initial air volume over the range displayed. It is also apparent that the slope of the line describing the relationship between total cycle time and initial air volume increases with increasing effective valve flow coefficient. It is appreciated that the graphical representation of the total cycle time may be displayed, in the alternative, as a function of the effective valve flow coefficient for various values of initial air volume of the air cavity. It is also apparent that the graphical representation of the total cycle time may be displayed, or otherwise considered, as a function of a ratio of the initial volume of the air cavity to the effective valve flow coefficient.

With continued reference to FIG. 8, a ratio of the initial volume of the air cavity to the effective valve flow coefficient can be interpreted from the graph for various total cycle times. Specifically, in order to provide a total cycle time of less than 5 milliseconds, the ratio of initial air volume (in $mm^3$) to effective valve flow coefficient should be less than about 3900 $mm^3$. As an example and with reference to FIG. 8, an initial air volume of about 800 $mm^3$ requires an effective valve flow coefficient of less than or equal to about 0.21, which represents a ratio of about 3800 $mm^3$, to achieve a cycle time of less than or equal to about 5 milliseconds. Similarly, the simulations indicate that the ratio of initial volume (in $mm^3$) to effective valve flow coefficient should be less than about 7500 $mm^3$ to provide a total cycle time of less than 9 milliseconds. A similar determination of the ratio of initial air volume to effective valve flow coefficient may be made from the simulations and, in particular, from FIG. 8 for other cycle times if either the effective valve flow coefficient or the initial air volume for the air cavity is specified as a known value.

Simulating the operation of the liquid dispensing module, based on a model of the physical system, can provide valuable design information and insights regarding the physical response of the module. The simulations can predict a combination of effective valve flow coefficient and initial volume of the air cavity for providing a total cycle time that is less than a specified design goal, such as, for example, a total cycle time of 5 milliseconds. Actual liquid dispensing modules can be prototyped by numerical simulation to provide design principles and parameters using simulation operation. Such a practice reduces the number of actual experiments with prototyped devices required to reach a final module design, resulting in considerable savings of time and money as well as the possibility of improved functionality and effective operation of the module. Further, the results of the simulation will permit the use of a smaller, faster, less expensive solenoid valve that can be easily matched to the initial air volume of the air cavity. It is apparent that the results presented in FIG. 8 may be obtained empirically from actual measurements of the total cycle time, the initial air volume of the air cavity, and the effective valve flow coefficient of various, differing pneumatic actuators.

The initial air volume of the air cavity includes all air spaces between the air cavity side of the switching mechanism of the solenoid valve and the barrier imposed by the air piston in the air cavity. Also included in the initial volume are any air spaces provided by any fittings, lengths of tubing or nipples between the air outlet of the access duct from the solenoid and the air inlet of air passageway leading to the air cavity. It is apparent that the initial air volume may be minimized if intervening fittings, lengths of tubing or nipples are not disposed between the air outlet and air inlet and the air outlet is directly coupled in fluid communication with the air inlet.

The determination of initial air cavity volume and effective valve flow coefficient is beneficial for all liquid dispensing applications. Dispensing applications that dispense heated liquids may need to limit the transfer of heat from other portions of the liquid dispensing module and/or the liquid distribution manifold to the solenoid valve. For certain heated liquid dispensing applications, the thermal isolation must be capable of limiting the temperature of the solenoid valve to less than about 140° F. In other liquid dispensing applications that can tolerate the slowing effect of high temperature seals, the thermal isolation must be capable of limiting the temperature of the solenoid valve to less than about 225° F. For example, the heat transfer may be reduced by positioning a thermally insulating shield between the solenoid valve and the liquid distribution manifold providing heated liquid to the liquid dispensing module. Thermally insulating shields suitable for such thermal isolation would include, but not be limited to, the thermally insulating shields 100, 104, 108, or 112 described above.

While the present invention has been illustrated by a description of various preferred embodiments and while these embodiments have been described in considerable detail in order to describe the best mode of practicing the invention, it is not the intention of applicant to restrict or in any way limit the scope of the appended claims to such detail. Additional advantages and modifications within the spirit and scope of the invention will readily appear to those skilled in the art. The invention itself should only be defined by the appended claims, wherein I claim:

The invention claimed is:

1. A method of optimizing a cycle time of a liquid dispensing module including an air piston housing with an air cavity having an initial air volume used to actuate the liquid dispensing module, an air piston located in the air cavity, and a solenoid valve capable of controlling the flow of pressurized air to and from the air cavity and having an effective valve flow coefficient, the method comprising:

selecting the initial air volume of the air cavity and the effective valve flow coefficient of the solenoid valve such that a cycle time of the liquid dispensing module is less than or equal to 9 milliseconds.

2. The method of claim 1 wherein the cycle time is less than or equal to 5 milliseconds.

3. The method of claim 1 wherein the effective valve flow coefficient is between about 0.1 to about 1.4.

4. The method of claim 1 wherein the initial air volume is less than about 2170 $mm^3$.

5. The method of claim 1 wherein the initial air volume is less than about 1500 $mm^3$.

6. The method of claim 1 wherein selecting the initial air volume of the air cavity and the effective valve flow coefficient of the solenoid valve further comprises:

modeling operation of the liquid dispensing module with a mathematical model represented by a set of equations; and numerically solving the set of equations to select the initial air volume and the effective valve flow coefficient.

7. The method of claim 2 wherein the initial air volume is less than about 2170 $mm^3$.

8. The method of claim 2 wherein the initial air volume is less than about 1500 $mm^3$.

9. The method of claim 2 wherein the effective valve flow coefficient is between about 0.1 to about 1.4.

10. The method of claim 9 wherein the initial air volume is less than about 2170 $mm^3$.

11. The method of claim 9 wherein the initial air volume is less than about 1500 $mm^3$.

12. The method of claim 3 wherein the initial air volume is less than about 2170 $mm^3$.

13. The method of claim 3 wherein the initial air volume is less than about 1500 $mm^3$.

14. A liquid dispensing module for dispensing a liquid onto a substrate, comprising:

a dispenser body including a discharge outlet, said dispenser body capable of receiving a flow of the liquid and discharging the flow of the liquid from said discharge outlet, said dispenser body including a flow-control mechanism characterized by an open position in which the flow of the liquid is discharged from the discharge outlet and a closed position in which the flow of the liquid is blocked, said dispenser body further including a nozzle-receiving space flanked by a wedge-shaped recess and a threaded passageway;

a set screw threadingly received within said threaded passageway;

an actuator operatively coupled with said flow-control mechanism, said actuator capable of actuating said flow-control mechanism between the open and the closed positions to selectively dispense the liquid from said discharge outlet; and a nozzle removably mounted within said nozzle-receiving space of the dispenser body in fluid communication with said discharge outlet, said nozzle having a wedge-shaped side portion that is engaged with said wedge-shaped recess in said nozzle-receiving space when said set screw is advanced in said threaded passageway to apply a force against said nozzle.

15. A liquid dispensing module for dispensing a liquid onto a substrate, comprising:

a dispenser body including a liquid inlet, a discharge outlet, a liquid recirculation outlet, and a flow channel capable of directing a flow of the liquid from said liquid inlet to said discharge outlet and said recirculation outlet;

a first valve seat disposed in said flow channel between said recirculation outlet and said liquid inlet;

a second valve seat disposed in said flow channel between said discharge outlet and said liquid inlet;

a first valve stem segment including a first valve plug;

a second valve stem segment including a second valve plug, said second valve stem segment operatively coupled for movement with said first valve stem segment, said first and said second valve stem segments being movable between a first position in which said first valve plug contacts said first valve seat to stop the flow of the liquid from said liquid inlet to said recirculation outlet and said second valve plug is out of contact with said valve seat to permit the flow of the liquid from said liquid inlet to said discharge outlet and a second position in which said first valve plug is out of contact with said first valve seat to permit the flow of the liquid from said liquid inlet to said recirculation outlet and said second valve plug contacts said second valve seat to halt the flow of the liquid from said liquid inlet to said discharge outlet; and an actuator associated with said dispenser body, said actuator operatively coupled with one of said first and said second valve stem segments to selectively apply an actuation force for moving said first and said second valve stem segments to provide said first and said second positions for selectively dispensing the flow of the liquid from said discharge outlet.

16. The liquid dispensing module of claim 15 wherein said actuator is operatively coupled with said first valve stem segment.

17. The liquid dispensing module of claim 15 wherein said first valve plug is a spherical head and said first valve seat includes an annular sealing surface capable of making a sealing engagement with said spherical head.

18. The liquid dispensing module of claim 15 wherein said second valve plug includes a first frustoconical sealing surface and said second valve seat includes a second frustoconical sealing surface capable of making a sealing engagement with said first frustoconical sealing surface.

19. The liquid dispensing module of claim 15 further comprising:

a first biasing element for applying a first biasing force to said first valve stem segment that urges said first valve plug in a direction toward said first valve seat.

20. The liquid dispensing module of claim 19 further comprising:

a second biasing element for applying a second biasing force to said second valve stem segment that urges said second valve plug in a direction toward said second valve seat.

21. The liquid dispensing module of claim 20 wherein said second biasing force is greater than said first biasing force so that said first and said second valve stem segments are in said second position when said actuation force is not applied.

22. The liquid dispensing module of claim 20 wherein the sum of said first biasing force and said actuation force is larger than said second biasing force so that said first and said second valve stem segments are in said second position when said actuation force is applied.

23. The liquid dispensing module of claim 15 wherein said first valve plug is located between said first valve seat and said recirculation outlet.

24. The liquid dispensing module of claim 15 wherein said second valve plug is located between said second valve seat and said discharge outlet.

25. A dispensing apparatus for dispensing a liquid, comprising:

a liquid distribution manifold capable of heating the liquid;

a dispenser body capable of receiving a flow of the liquid from said liquid distribution manifold, said dispenser body including a flow-control mechanism having an open condition in which the flow of the liquid is discharged from said dispenser body and a closed condition in which the flow of the liquid is blocked;

a pneumatic actuator including a solenoid valve, an air piston housing coupled pneumatically with said solenoid valve, an air cavity defined within said air piston housing, and an air piston positioned within said air cavity, said air piston being coupled with said flow-control mechanism for providing said open and said closed conditions in response to a flow of pressurized air to said air cavity from said solenoid valve; and a thermally insulating shield positioned between said air piston housing and said liquid distribution manifold, said thermally insulating shield capable of reducing heat transfer from said liquid distribution manifold to said air piston housing.

26. The dispensing apparatus of claim 25, wherein said air piston housing includes a first material characterized by a first thermal conductivity and said thermally insulating shield includes a second material characterized by a second thermal conductivity that is less than the first thermal conductivity.

27. The dispensing apparatus of claim 26, wherein said second material is a nonmetal.

28. The dispensing apparatus of claim 27, wherein said nonmetal is a material selected from the group consisting of ceramics, polymers and glass fibers.

29. The dispensing apparatus of claim 25, wherein said thermally insulating shield is an imperforate member.

30. The dispensing apparatus of claim 25, wherein said thermally insulating shield includes a flat panel contacting said air piston housing and a plurality of projections extending between said flat panel and said liquid distribution manifold, said flat panel characterized by a first cross-sectional area and each of said projections characterized by a second cross-sectional area that is smaller than said first cross-sectional area for reducing the conduction of heat from said liquid distribution manifold to said flat panel.

31. The dispensing apparatus of claim 25, wherein said thermally insulating shield includes a spacer having a sidewall bounding an enclosed space filled with a gas, said sidewall extending between said air piston housing and said liquid distribution manifold.

32. The dispensing apparatus of claim 31, wherein said thermally insulating shield includes one or more dividing walls that compartmentalize said enclosed space.

33. The dispensing apparatus of claim 31, wherein said sidewall includes a perimeter enclosed between said air piston housing and said heated support structure so that the gas in said enclosed space is substantially stagnant.

34. The dispensing apparatus of claim 25 wherein said thermally insulating shield includes a throughbore that reduces an effective cross-sectional area of said thermally insulating shield.

35. The dispensing apparatus of claim 34 wherein said throughbore includes a perimeter enclosed between said air piston housing and said liquid distribution manifold such that a gas confined therein is substantially stagnant.

36. A method of intermittently dispensing a liquid from a liquid dispensing module having a discharge outlet and a flow-control mechanism movable with a pneumatic actuator during a cycle time, the cycle time defined as a sum of a first duration to move the flow-control mechanism from a closed position to an open position to dispense the liquid from the discharge outlet and a second duration to move the flow-control mechanism from the open position to the closed position to stop dispensing the liquid from the discharge outlet, the method comprising:

A) moving the flow-control mechanism with the pneumatic actuator from the closed position to the open position in a first portion of the cycle time to dispense the liquid from the discharge outlet;

B) moving the flow-control mechanism with the pneumatic actuator from the open position to the closed position in a second portion of the cycle time to stop dispensing the liquid from the discharge outlet, wherein the cycle time is less than or equal to 9 milliseconds; and C) repeating the steps A and B for a selected number of times.

37. The method of claim 36 wherein the cycle time is less than or equal to 5 milliseconds.

38. The method of claim 36 wherein the pneumatic actuator is characterized by an effective valve flow coefficient ranging from about 0.1 to about 1.4.

39. The method of claim 36 wherein the pneumatic actuator includes an air piston housing containing an air cavity and an air piston located in the air cavity, the air cavity being characterized by an initial air volume used to actuate the flow-control mechanism that is less than about 2170 $mm^3$.

40. The method of claim 37 wherein the pneumatic actuator is characterized by an effective valve flow coefficient ranging from about 0.1 to about 1.4.

41. The method of claim 40 wherein the pneumatic actuator includes an air piston housing containing an air cavity and an air piston located in the air cavity, the air cavity being characterized by an initial air volume used to actuate the flow-control mechanism that is less than about 2170 $mm^3$.

42. The method of claim 40 wherein the pneumatic actuator includes an air piston housing containing an air cavity and an air piston located in the air cavity, the air cavity being characterized by an initial air volume used to actuate the flow-control mechanism that is less than about 1500 $mm^3$.

43. The method of claim 37 wherein the pneumatic actuator includes an air piston housing containing an air cavity and an air piston located in the air cavity, the air cavity being characterized by an initial air volume used to actuate the flow-control mechanism that is less than about 2170 $mm^3$.

44. The method of claim 37 wherein the pneumatic actuator includes an air piston housing containing an air cavity and an air piston located in the air cavity, the air cavity being characterized by an initial air volume used to actuate the flow-control mechanism that is less than about 1500 $mm^3$.

45. The method of claim 38 wherein the pneumatic actuator includes an air piston housing containing an air cavity and an air piston located in the air cavity, the air cavity being characterized by an initial air volume used to actuate the flow-control mechanism that is less than about 2170 $mm^3$.

46. The method of claim 38 wherein the pneumatic actuator includes an air piston housing containing an air cavity and an air piston located in the air cavity, the air cavity being characterized by an initial air volume used to actuate the flow-control mechanism that is less than about 1500 $mm^3$.

47. The method of claim 36 wherein the pneumatic actuator includes an air piston housing containing an air cavity and an air piston located in the air cavity, the air cavity being characterized by an initial air volume used to actuate the flow-control mechanism that is less than about 1500 $mm^3$.

48. A liquid dispensing module for dispensing a liquid onto a substrate, comprising:

a dispenser body including a liquid inlet, a discharge outlet, a liquid recirculation outlet, and a flow channel capable of directing a flow of the liquid from said liquid inlet to said discharge outlet and said recirculation outlet;

an actuator;

a first valve seat disposed in said flow channel between said recirculation outlet and said liquid inlet;

a second valve seat disposed in said flow channel between said discharge outlet and said liquid inlet; and a valve stem operatively coupled with said actuator, said valve stem including a first valve plug and a second valve plug, said valve stem being movable by said actuator between a first position in which said first valve plug contacts said first valve seat and said second valve plug is out of contact with said second valve seat to permit the flow of the liquid from said liquid inlet to said discharge outlet and a second position in which said first valve plug is out of contact with said first valve seat to permit the flow of the liquid from said liquid inlet to said recirculation outlet and said second valve plug contacts said second valve seat.

49. The liquid dispensing module of claim 48 wherein said first valve plug is a spherical head and said first valve seat includes an annular sealing surface capable of making a sealing engagement with said spherical head.

50. The liquid dispensing module of claim 48 wherein said second valve plug includes a first frustoconical sealing surface and said second valve seat includes a second frustoconical sealing surface capable of making a sealing engagement with said first frustoconical sealing surface.

51. The liquid dispensing module of claim 48 wherein said first valve plug is located between said first valve seat and said recirculation outlet.

52. The liquid dispensing module of claim 48 wherein said second valve plug is located between said second valve seat and said discharge outlet.

53. The method of claim 2 wherein selecting the initial air volume of the air cavity and the effective valve flow coefficient of the solenoid valve futher comprises:

modeling operation of the liquid dispensing module with a mathematical model represented by a set of equations; and numerically solving the set of equations to select the initial air volume and the effective valve flow coefficient.

* * * * *

UNITED STATES PATENT AND TRADEMARK OFFICE

CERTIFICATE OF CORRECTION

PATENT NO. : 7,156,261 B2 
APPLICATION NO. : 10/657401
DATED : January 2, 2007
INVENTOR(S) : Saidman et al.

It is certified that error appears in the above-identified patent and that said Letters Patent is hereby corrected as shown below:

Column 2:
Line 13, after "desirable" insert --to--.
Line 21, change "position" to --piston--.
Line 31, after "must" insert --be--.

Column 4, line 48, change "4 A C" to --4A-C--.
Column 5, line 21, change "are" to --is--.
Column 10, line 42, after "68" insert --to--.
Column 14, line 37, change "4 A C" to --4A-C--.
Column 15, line 28, change "addition" to --additional--.
Column 17, line 24, after "extends" delete --through--.
Column 20, line 39, change "QdQut" to --QdOut--.
Column 21, line 36, change "ll" to --π--.
Column 22, line 40, change "is" to --are--.

Column 23:
Line 36, change "-" to --=--.
Line 48, change "-" to --=--.
Line 59, change "-" to --=--.

Column 26:
Line 44, change "applicant" to --applicants--.
Line 49, change "I" to --we--.

Signed and Sealed this

Seventeenth Day of July, 2007

JON W. DUDAS
*Director of the United States Patent and Trademark Office*